US007471046B2

(12) United States Patent
Lee et al.

(10) Patent No.: US 7,471,046 B2
(45) Date of Patent: Dec. 30, 2008

(54) APPARATUS AND METHOD FOR DRIVING PLASMA DISPLAY PANEL

(75) Inventors: Jun-Young Lee, Cheonan (KR); Seung-Woo Chang, Asan (KR); Jin-Sung Kim, Cheonan (KR); Hak-Ki Choi, Cheonan (KR); Chan-Young Han, Asan (KR)

(73) Assignee: Samsung SDI Co., Ltd., Suwon (KR)

( * ) Notice: Subject to any disclaimer, the term of this patent is extended or adjusted under 35 U.S.C. 154(b) by 212 days.

(21) Appl. No.: 11/140,975

(22) Filed: Jun. 1, 2005

(65) Prior Publication Data

US 2005/0225255 A1 Oct. 13, 2005

Related U.S. Application Data

(63) Continuation of application No. 10/681,257, filed on Oct. 9, 2003, now Pat. No. 7,023,139.

(30) Foreign Application Priority Data

Oct. 11, 2002 (KR) ..... 2002-62095
Nov. 13, 2002 (KR) ..... 2002-70383

(51) Int. Cl.
*G09G 3/10* (2006.01)

(52) U.S. Cl. ..... 315/169.4; 315/169.1

(58) Field of Classification Search ..... 315/169.1, 315/169.3, 169.4, 169.2, 209 R; 345/60, 345/67, 211
See application file for complete search history.

(56) References Cited

U.S. PATENT DOCUMENTS

| | | | | |
|---|---|---|---|---|
| 4,866,349 | A | 9/1989 | Weber et al. | 315/169.1 |
| 5,081,400 | A | 1/1992 | Weber et al. | 315/169.1 |
| 5,808,420 | A | 9/1998 | Rilly et al. | 313/365 |
| 6,175,192 | B1 | 1/2001 | Moon | 345/205 |
| 6,674,417 | B2 * | 1/2004 | Hsu et al. | 345/60 |
| 6,781,322 | B2 * | 8/2004 | Onozawa et al. | 315/169.3 |
| 6,943,757 | B2 * | 9/2005 | Huang et al. | 345/60 |
| 6,963,174 | B2 * | 11/2005 | Lee et al. | 315/169.3 |
| 7,027,010 | B2 * | 4/2006 | Lee | 345/60 |
| 2003/0025459 | A1 | 2/2003 | Lee et al. | 315/169.1 |
| 2003/0057854 | A1 * | 3/2003 | Roh | 315/169.3 |
| 2003/0160569 | A1 * | 8/2003 | Kim et al. | 315/169.1 |
| 2005/0116887 | A1 * | 6/2005 | Lee et al. | 345/60 |

FOREIGN PATENT DOCUMENTS

| | | |
|---|---|---|
| CN | 1347070 A1 | 5/2002 |
| JP | 05265397 | 10/1993 |
| JP | 07-160219 | 6/1995 |
| JP | 09-297563 | 11/1997 |
| JP | 09-325735 | 12/1997 |

(Continued)

*Primary Examiner*—Douglas W. Owens
*Assistant Examiner*—Jimmy T Vu
(74) *Attorney, Agent, or Firm*—H.C. Park & Associates, PLC

(57) ABSTRACT

In a PDP, an inductor is coupled to an electrode of a panel capacitor. A current of a first direction is injected to the inductor to store energy, and the voltage of the electrode is changed to $V_s/2$ using a resonance between the inductor and the panel capacitor and the stored energy. The difference between the Y electrode voltage $V_s/2$ and the X electrode voltage $-V_s/2$ causes a sustain on the panel. Subsequently, a current of a second direction, which is opposite to the first direction, is injected to the inductor to store energy therein. The voltage of the electrode is changed to $-V_s/2$ using a resonance between the inductor and the panel capacitor and the energy stored therein.

20 Claims, 19 Drawing Sheets

FOREIGN PATENT DOCUMENTS

| | | |
|---|---|---|
| JP | 10-105114 | 4/1998 |
| JP | 10149135 | 6/1998 |
| JP | 11-352927 | 12/1999 |
| JP | 11344948 | 12/1999 |
| JP | 2000047634 | 2/2000 |
| JP | 2000-242225 | 9/2000 |
| JP | 2001134233 | 5/2001 |
| JP | 2001-331147 | 11/2001 |
| JP | 2002062843 | 2/2002 |
| JP | 2002-116731 | 4/2002 |
| JP | 2004-513398 | 4/2004 |
| WO | 0239419 | 5/2002 |

* cited by examiner

APPARATUS AND METHOD FOR DRIVING PLASMA DISPLAY PANEL

CROSS REFERENCE TO RELATED APPLICATIONS

This application is a continuation of U.S. patent application Ser. No. 10/681,257, filed Oct. 9, 2003 now U.S. Pat. No. 7,023,139, which in turn claims the benefit of Korean Patent Application No. 2002-62095 filed on Oct. 11, 2002 and Korean Patent Application No. 2002-70383 filed on Nov. 13, 2002, both of which are hereby incorporated by reference for all purposes as if fully set forth herein.

BACKGROUND OF THE INVENTION (a) Field of the Invention

The invention relates to an apparatus and method for driving a plasma display panel (PDP), and more particularly, a driver circuit which includes a power recovery circuit.

(b) Description of the Related Art

The PDP is a flat panel display that uses plasma generated by gas discharge to display characters or images and includes, according to its size, more than several scores to millions of pixels arranged in a matrix pattern. PDPs may be classified as a direct current (DC) type or an alternating current (AC) type based on the structure of its discharge cells and the waveform of the driving voltage applied thereto.

DC PDPs have electrodes exposed to a discharge space to allow a DC to flow through the discharge space while the voltage is applied, and thus require a resistance for limiting the current. AC PDPs have electrodes covered with a dielectric layer that forms a capacitance component to limit the current and protects the electrodes from the impact of ions during a discharge. Thus, AC PDPs generally have longer lifetimes than DC PDPs.

One side of the AC PDP has scan and sustain electrodes formed in parallel, and the other side of the AC PDP has address electrodes perpendicular to the scan and sustain electrodes. The sustain electrodes are formed in correspondence to the scan electrodes and have the one terminal coupled to the one terminal of each scan electrode.

The method for driving the AC PDP generally includes a reset period, an addressing period, a sustain period, and an erase period in temporal sequence.

The reset period is for initiating the status of each cell so as to facilitate the addressing operation. The addressing period is for selecting turn-on/off cells and applying an address voltage to the turn-on cells (i.e., addressed cells) to accumulate wall charges. The sustain period is for applying sustain pulses and causing a sustain-discharge for displaying an image on the addressed cells. The erase period is for reducing the wall charges of the cells to terminate the sustain-discharge.

The discharge spaces between the scan and sustain electrodes and between the side of the PDP with the address electrodes and the side of the PDP with the scan and sustain electrodes act as a capacitance load (hereinafter, referred to as "panel capacitor"). Accordingly, capacitance exists on the panel. Due to the capacitance of the panel capacitor, there is a need for a reactive power to apply a waveform for the sustain-discharge. Thus, the PDP driver circuit includes a power recovery circuit for recovering the reactive power and reusing it. One power recovery circuit is disclosed in U.S. Pat. Nos. 4,866,349 and 5,081,400, issued to Weber, et al. (herinafter "Weber").

The circuit disclosed in Weber repeatedly transfers the energy of the panel to a power recovery capacitor or the energy stored in the power recovery capacitor to the panel using a resonance between the panel capacitor and the inductor. Thus, the circuit's effective power is recovered. In this circuit, however, the rising time and the falling time of the panel voltage are dependent upon the time constant LC determined by the inductance L of the inductor and the capacitance C of the panel capacitor. The rising time of the panel voltage is equal to the falling time because the time constant LC is constant. For a faster rising time of the panel voltage, the switch coupled to the power source has to be hard-switched during the rise of the panel voltage, in which case the stress of the switch increases. The hard-switching operation also causes a power loss and increases the effect of electromagnetic interference (EMI).

SUMMARY OF THE INVENTION

This invention provides a PDP driver circuit that controls the rising and falling times of the panel voltage.

This invention separately provides a PDP driver circuit that controls X electrodes and Y electrodes in an independent manner.

The invention separately provides a driving apparatus and method for driving a PDP having a first electrode and a second electrode between which a panel capacitor is formed.

In one aspect of the present invention, a method for driving a plasma display panel, which has a first electrode and a second electrode with a panel capacitor formed therebetween. The method comprises injecting a current of a first direction to an inductor coupled to the first electrode to store a first energy, while voltages of the first electrode and the second electrode are both sustained at a first voltage. The method further includes changing the voltage of the first electrode to a second voltage by using a resonance between the inductor and the panel capacitor and the first energy, while the voltage of the second electrode is sustained at the first voltage, and recovering energy remaining in the inductor, while the voltages of the first electrode and second electrode are sustained at the second voltage and the first voltage, respectively.

In another aspect of the present invention, a method for driving a plasma display panel, which has a first electrode and a second electrode with a panel capacitor formed therebetween, the method comprising changing a voltage of the first electrode to a second voltage by using a resonance between a first inductor and the panel capacitor, while a voltage of the second electrode is sustained at a first voltage, wherein the first inductor is coupled to the first electrode and sustaining the voltages of the first electrode and the second electrode at the second voltage and the first voltage, respectively. The method further includes changing the voltage of the first electrode to the first voltage by using a resonance between a second inductor and the panel capacitor, while the voltage of the second electrode is sustained at the first voltage, the second inductor being coupled to the first electrode, and sustaining the voltages of the first electrode and the second electrode at the first voltage.

In still yet another aspect of the present invention, an apparatus for driving a plasma display panel, which has a first electrode and a second electrode with a panel capacitor formed therebetween, the apparatus comprising an inductor coupled to the first electrode, a first path developing a third voltage, via an inductor, and a first power source for supplying a first voltage to inject a current of a first direction to the inductor, while voltages of the first electrode and the second electrode are both sustained at the first voltage, the third voltage being between the first voltage and a second voltage. The apparatus further includes a second path for causing an LC resonance with the third voltage, the inductor, and the panel capacitor to change the voltage of the first electrode from the first voltage to the second voltage, while the voltage of the second electrode is sustained at the first voltage and the current of the first direction flows to the inductor and a third path developing the third voltage via a second power source for supplying a second voltage, and the inductor to inject a current of a second direction to the inductor, while the voltages of the first electrode and the second electrodes are sustained at the second voltage and the first voltage, respectively, the second direction being opposite to the first direction. Further, the apparatus includes a fourth path for causing an LC resonance with the panel capacitor, the inductor, and the third voltage to change the voltage of the first electrode from the second voltage to the first voltage, while the voltage of the second electrode is sustained at the first voltage and the current of the second direction flows to the inductor.

In still another aspect of the invention provides an apparatus for driving a plasma display panel, which has a first electrode and a second electrode with a panel capacitor formed therebetween, the apparatus comprising a first inductor and a second inductor coupled to the first electrode and a first resonance path for causing a resonance between the first inductor and the panel capacitor to change a voltage of the first electrode to a second voltage, while a voltage of the second electrode is sustained at a first voltage. The invention further provides a second resonance path for causing a resonance between the second inductor and the panel capacitor to change the voltage of the first electrode to the first voltage, while a voltage of the second electrode is sustained to the first voltage, where the first inductor has a lower inductance than the second inductor.

In still another aspect of the invention, the invention provides a method for driving a plasma display panel, which has a first electrode and a second electrode with a panel capacitor formed therebetween, the method comprising storing a first energy in an inductor coupled between a capacitor charged with a predetermined voltage and the panel capacitor, charging the panel capacitor through the inductor charged with the first energy and storing a second energy in the inductor. The method further involves discharging the panel capacitor through the inductor charged with the second energy, where the predetermined voltage is controlled by amounts of the first energy and the second energy.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, exemplary embodiments of the invention have been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Hereinafter, an apparatus and method for driving a PDP according to an embodiment of the present invention will be described in detail with reference to the accompanying drawings.

Figure 1:
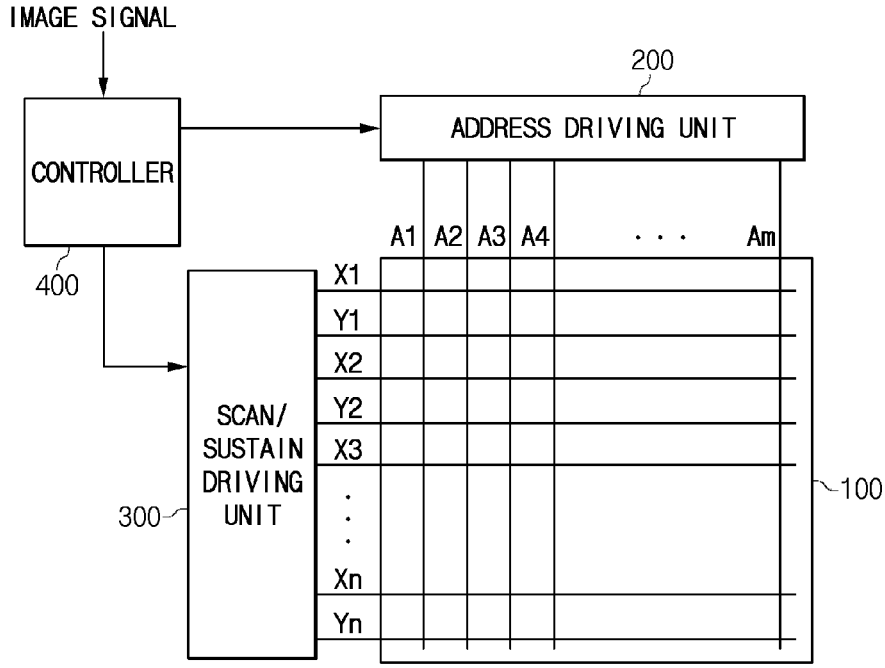
FIG. 1 is a schematic block diagram of a PDP according to an embodiment of the present invention.

FIG. 1 is a schematic block diagram of a PDP according to an embodiment of the present invention. As shown in FIG. 1, the PDP comprises, for example, a plasma panel 100, an address driver 200, a scan/sustain driver 300, and a controller 400.

The plasma panel 100 comprises a plurality of address electrodes $A_1$ to $A_m$ arranged in columns, and a plurality of scan electrodes (hereinafter, referred to as "Y electrodes") $Y_1$ to $Y_n$ and sustain electrodes (hereinafter, referred to as "X electrodes") $X_1$ to $X_n$ alternately arranged in rows. The X electrodes $X_1$ to $X_n$ are formed in correspondence to the Y electrodes $Y_1$ to $Y_n$, respectively. The one terminal of each X electrode is coupled to that of each Y electrode. The controller 400 receives an external image signal, generates an address drive control signal and a sustain control signal, and applies the generated control signals to the address driver 200 and the scan/sustain driver 300, respectively.

The address driver 200 receives the address drive control signal from the controller 400, and applies to each address electrode a display data signal for selecting of a discharge cell to be displayed. The scan/sustain driver 300 receives the sustain control signal from the controller 400, and applies sustain pulses alternately to the Y and X electrodes. The applied sustain pulses cause a sustain-discharge on the selected discharge cells.

Next, the sustain circuit of the scan/sustain driver 300 according to a first embodiment of the present invention will be described in detail with reference to FIGS. 2, 3 and 4.

Figure 2:
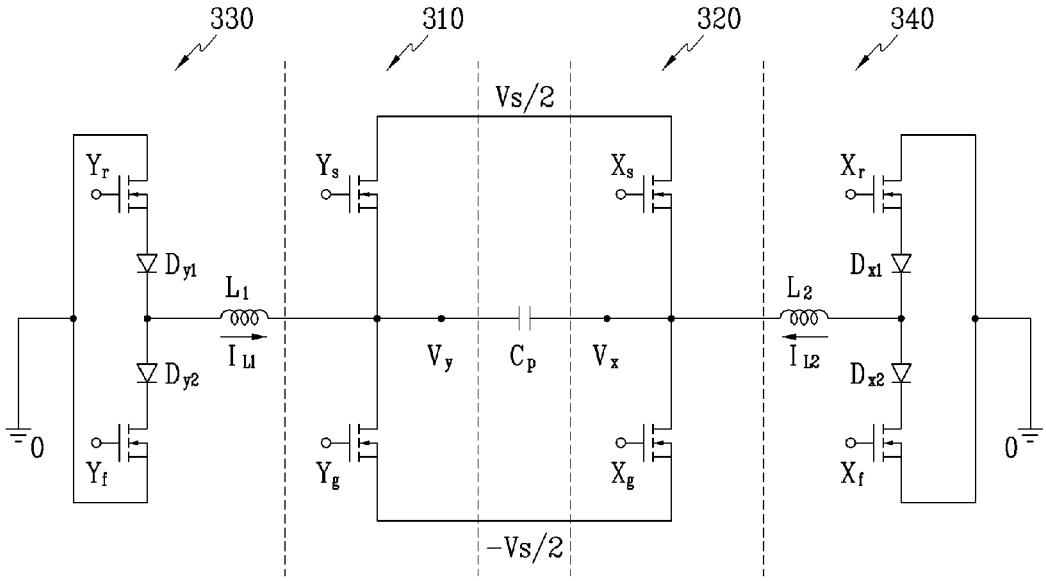
FIG. 2 is a schematic circuit diagram of a sustain circuit according to a first embodiment of the present invention.

FIG. 2 is a schematic circuit diagram of a sustain circuit according to the first embodiment of the present invention. The sustain circuit according to the first embodiment of the present invention comprises, as shown in FIG. 2, a Y electrode driver 310, an X electrode driver 320, a Y electrode power recovery section 330, and an X electrode power recovery section 340.

The Y electrode driver 310 is coupled to X electrode driver 320, and a panel capacitor $C_p$ is coupled between the Y electrode driver 310 and the X electrode driver 320. The Y electrode driver 310 includes switches $Y_s$ and $Y_g$, and the X electrode driver 320 includes switches $X_s$ and $X_g$. The Y electrode power recovery section 330 includes an inductor $L_1$ and switches $Y_r$ and $Y_f$, and the X electrode power recovery section 340 includes an inductor $L_2$ and switches $X_r$ and $X_f$. These switches $Y_s$, $Y_g$, $X_s$, $X_g$, $Y_r$, $Y_f$, $X_r$ and $X_f$ are illustrated as MOSFETs having a body diode, however, they may be any other switches that satisfy the following functions.

The switches $Y_s$ and $Y_g$ are coupled in series between a power source Vs/2 supplying a voltage of $V_s/2$ and a power source −Vs/2 supplying a voltage of $-V_s/2$, and their contact is coupled to the Y electrode of the panel capacitor $C_p$. Likewise, the switches $X_s$ and $X_g$ are coupled in series between a power source Vs/2 and a power source −Vs/2, and their contact is coupled to the X electrode of the panel capacitor $C_p$.

One terminal of the inductor $L_1$ is coupled to the Y electrode of the panel capacitor $C_p$, and the switches $Y_r$ and $Y_f$ are coupled in parallel between the other terminal of the inductor $L_1$ and a ground terminal 0. Likewise, one terminal of the inductor $L_2$ is coupled to the X electrode of the panel capacitor $C_p$, and the switches $X_r$ and $X_f$ are coupled in parallel between the other terminal of the inductor $L_2$ and a ground terminal 0. The Y electrode power recovery section 330 may further include diodes $D_{y1}$ and $D_{y2}$ for preventing a current path possibly formed by the body diodes of the switches $Y_r$ and $Y_f$. Likewise, the X electrode power recovery section 340 may further include diodes $D_{x1}$ and $D_{x2}$ for preventing a current path possibly formed by the body diodes of the switches $X_r$ and $X_f$. The Y and X electrode power recovery sections 330 and 340 may further include diodes for clamping to prevent the voltage at the other terminals of the inductors $L_1$ and $L_2$ from being greater than $V_s/2$ or less than $-V_s/2$, respectively.

Next, the sequential operation of the sustain circuit according to the first embodiment of the present invention will be described with reference to FIGS. 3 and 4*a* to 4*h*. FIG. 3 is a driving timing diagram of the sustain circuit according to the first embodiment of the present invention. FIGS. 4*a* to 4*h* are circuit diagrams showing the current path of each mode in the sustain circuit according to the first embodiment of the present invention. Here, the operation proceeds over the course of 16 modes M1 to M16, which are changed by the manipulation of switches. The phenomenon called "LC resonance" discussed herein is not a continuous oscillation but a variation of voltage and current caused by the inductor $L_1$ or $L_2$ and the panel capacitor $C_p$, when the switch $Y_r$, $Y_f$, $X_r$ or $X_f$ is turned on.

Prior to the operation of the circuit according to the first embodiment of the present invention, the switches $Y_g$ and $X_g$ are in the "ON" state, so the Y electrode voltage $V_y$ and the X electrode voltage $V_x$ of the panel capacitor $C_p$ are both sustained at $-V_s/2$. Further, the capacitance of the panel capacitor $C_p$ is C, and the inductances of the inductors $L_1$ and $L_2$ are $L_1$ and $L_2$, respectively.

Figure 3:
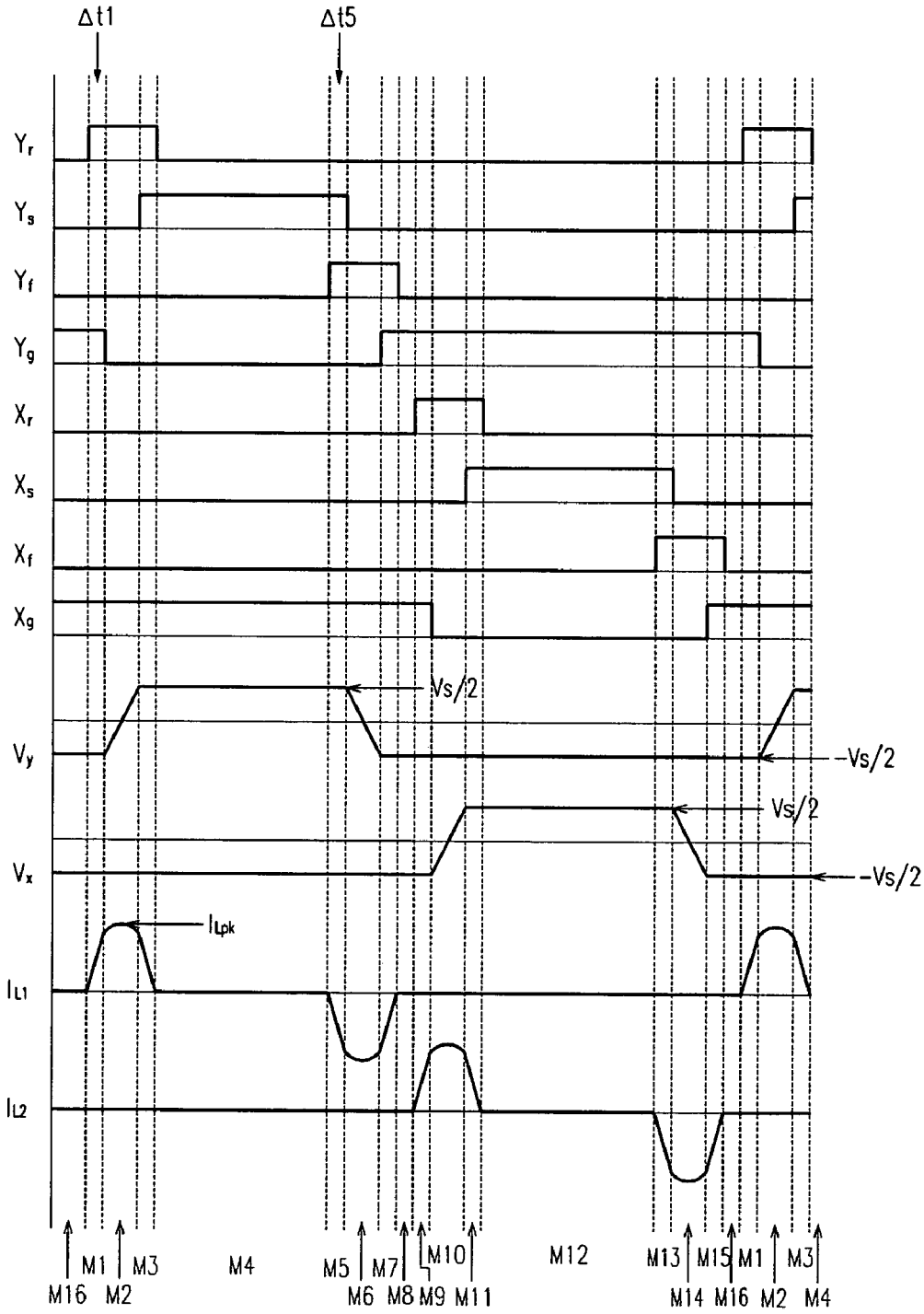
FIG. 3 is a driving timing diagram of the sustain circuit according to the first embodiment of the present invention.
Figure 4A:
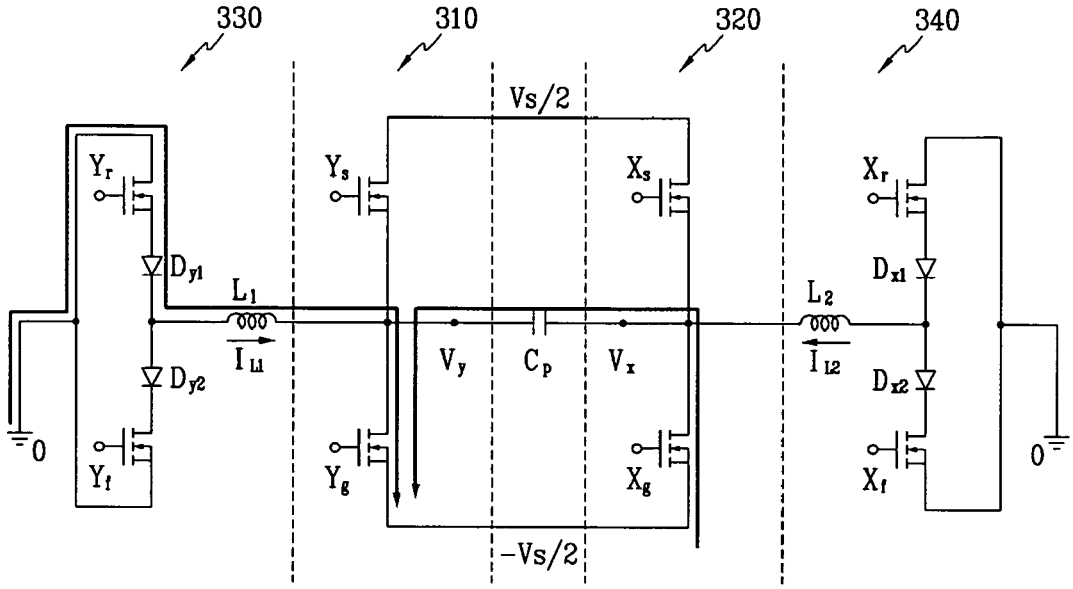
FIGS. 4A to 4H are circuit diagrams showing the current path of each mode in the sustain circuit according to the first embodiment of the present invention.

During mode 1 M1, as illustrated in FIGS. 3 and 4A, the switch $Y_r$ is turned ON, with the switches $Y_g$ and $X_g$ in the "ON" state. Then, a current $I_{L1}$ flowing to the inductor $L_1$ is increased with a slope of $V_s/2L_1$ via a current path that includes the ground terminal 0, the switch $Y_r$, the inductor $L_1$ and the switch $Y_g$ in sequence. During mode 1 M1, the current is injected to the inductor $L_1$ while the Y electrode voltage $V_y$ and the X electrode voltage $V_x$ of the panel capacitor $C_p$ are both sustained at $-V_s/2$. That is, the energy is stored (charged) in the inductor $L_1$. If mode 1 M1 lasts for a time period $\Delta t_1$, the current $I_{p1}$ flowing to the inductor $L_1$ is given by the following equation at the time when the mode 1 M1 ends.

$$I_{p1} = \frac{V_s}{2L_1}\Delta t_1 \qquad \text{[Equation 1]}$$

Figure 4B:
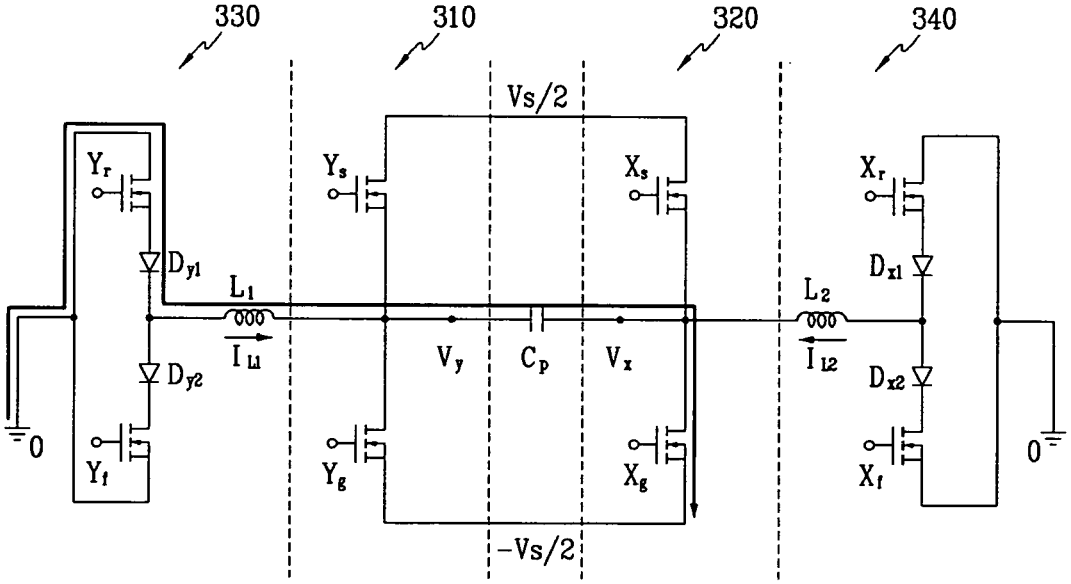

During mode 2 M2, as illustrated in FIGS. 3 and 4B, the switch $Y_g$ is turned OFF to form a current path that includes the ground terminal 0, the switch $Y_r$, the inductor $L_1$, the panel capacitor $C_p$, the switch $X_g$, and the power source −Vs/2 in sequence, thereby causing an LC resonance. Due to the LC resonance, the Y electrode voltage $V_y$ of the panel capacitor $C_p$ is increased, particularly to $V_s/2$ by the body diode of the switch $Y_s$. The LC resonance occurs while a predetermined amount of current flows to the inductor $L_1$, so the time $\Delta T_r$ required to raise the Y electrode voltage $V_y$ of the panel capacitor $C_p$ to $V_s/2$ is dependent upon the current $I_{p1}$ flowing to the inductor $L_1$ during the resonance. Namely, as expressed by the equation 2, the rising time $\Delta T_r$ of the Y electrode voltage $V_y$ is determined by the time period $\Delta t_1$ of injecting the current $I_{p1}$, i.e., the current of the mode 1 M1.

$$\Delta T_r = \sqrt{L_1 C_p}\left[\cos^{-1}\left(-\frac{V_s/2}{\sqrt{(V_s/2)^2 + \left(I_{p1}\sqrt{L_1/C_p}\right)^2}}\right) - \tan^{-1}\frac{I_{p1}\sqrt{L_1/C_p}}{V_s/2}\right] \qquad \text{[Equation 2]}$$

Figure 4C:
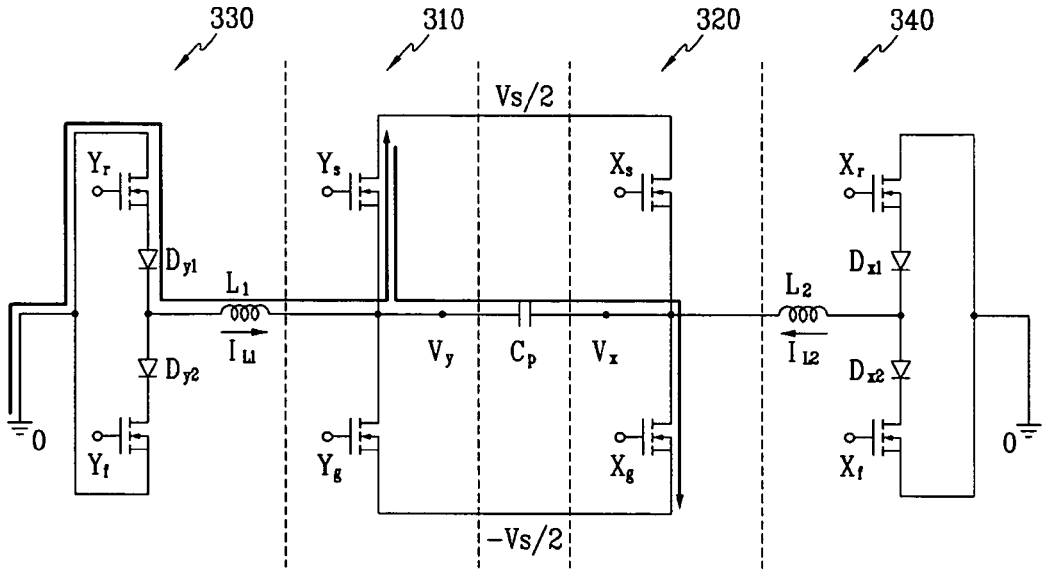

During mode 3 M3, the switch $Y_s$ is turned ON when the Y electrode voltage $V_y$ is increased to $V_s/2$, so the Y electrode voltage $V_y$ is sustained at $V_s/2$. As illustrated in FIG. 4C, the current $I_{L1}$ flowing to the inductor $L_1$ is decreased to 0 A with a slope of $-V_s/2L$, on the current path that includes the switch $Y_r$, the inductor $L_1$, and the body diode of the switch $Y_s$ in sequence. Namely, the current $I_{L1}$ flowing to the inductor $L_1$ is recovered to the power source Vs/2.

Figure 4D:
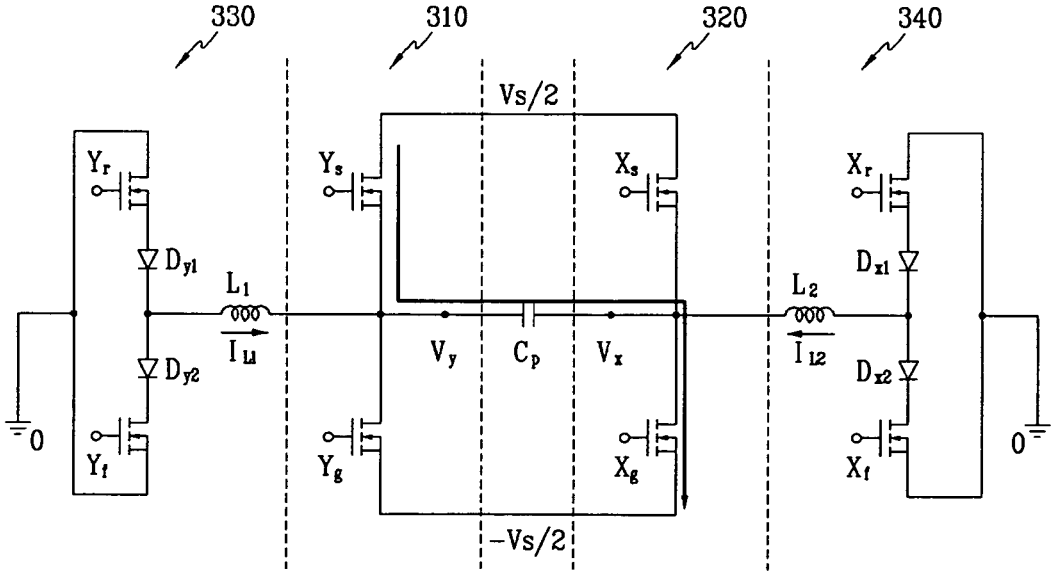

Referring to FIGS. 3 and 4D, during mode 4 M4, the switch $Y_r$ is turned OFF after the current $L_{L1}$ flowing to the inductor $L_1$ becomes 0 A. With the switches $Y_s$ and $X_g$ in the "ON" state, the Y electrode voltage $V_y$ and the X electrode voltage $V_x$ of the panel capacitor $C_p$ are sustained at $V_s/2$ and $-V_s/2$, respectively. The voltage difference ($V_y$−$V_x$) between the Y and X electrodes is equal to the voltage $V_s$ necessary for a sustain-discharge (referred to as a sustain-discharge voltage hereinafter), causing a sustain-discharge.

Figure 4E:
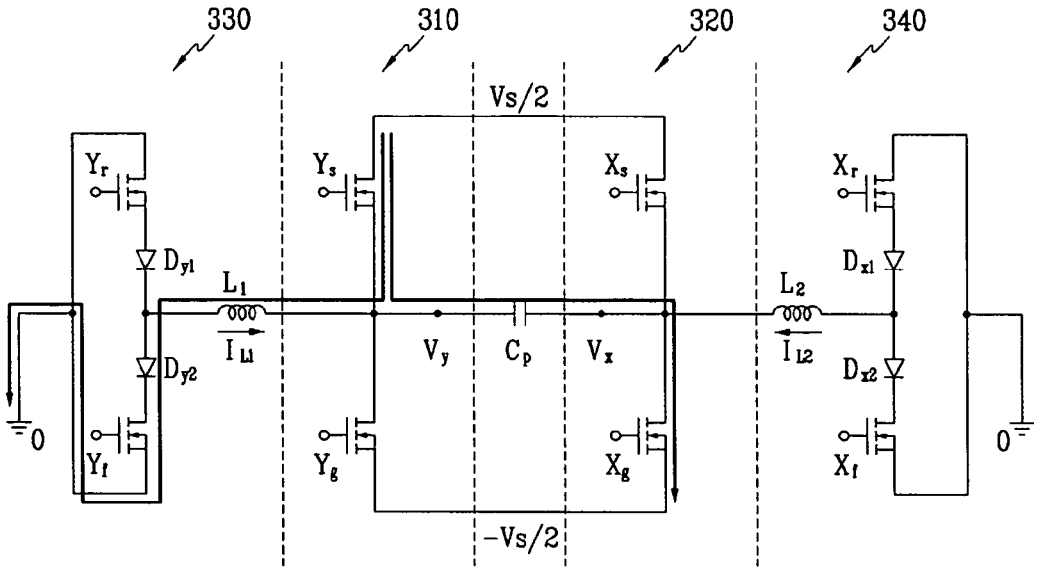

During mode 5 M5, as illustrated in FIGS. 3 and 4E, the switch $Y_f$ is turned ON with the switches $Y_s$ and $X_g$ in the "ON" state. Then, a current path is formed that includes the power source $V_s/2$, the switch $Y_s$, the inductor $L_1$, the switch $Y_f$, and the ground terminal 0 in sequence, so the current flowing to the inductor $L_1$ is decreased with a slope of $-V_s/2L_1$. During mode 5 M5, a current in the reverse direction of the current of the mode 1 M1 is injected to the inductor $L_1$ while the Y electrode voltage $V_y$ and the X electrode voltage $V_x$ of the panel capacitor $C_p$ are sustained at $V_s/2$ and $-V_s/2$, respectively. That is, the energy is charged in the inductor $L_1$.

Figure 4F:
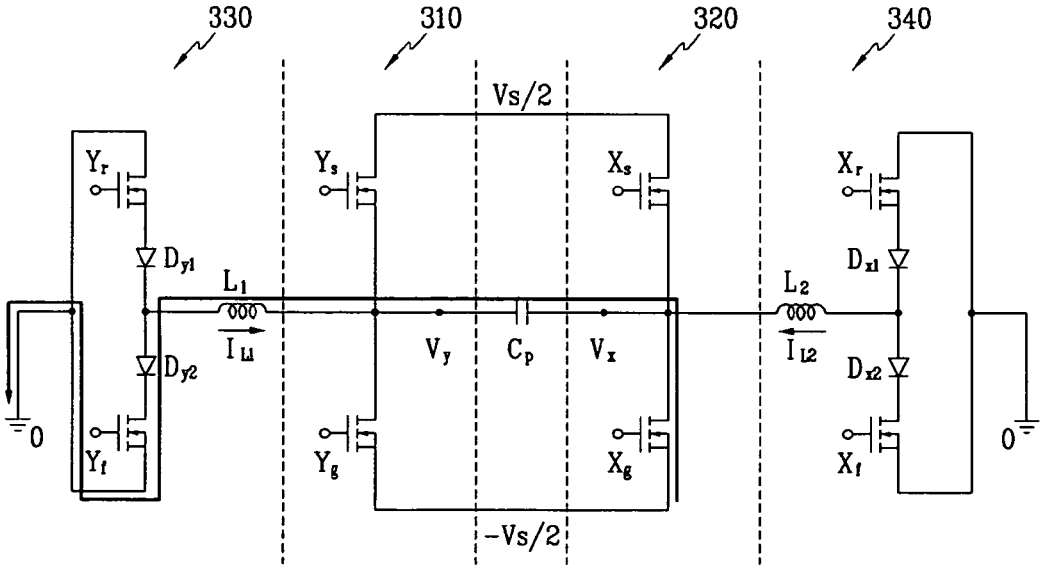

During mode 6 M6, as illustrated in FIGS. 3 and 4F, the switch $Y_s$ is turned OFF to form a current path that includes the body diode of the switch $X_g$, the panel capacitor $C_p$, the inductor $L_1$, the switch $Y_f$, and the ground terminal 0 in sequence, thereby causing an LC resonance. Due to the LC resonance, the Y electrode voltage $V_y$ of the panel capacitor $C_p$ is decreased, particularly to $-V_s/2$ by the body diode of the switch $Y_g$. The LC resonance occurs while a predetermined amount of current is flowing to the inductor $L_1$, as in the mode 2 M2. So, the time $\Delta T_f$ required to decrease the Y electrode voltage $V_y$ of the panel capacitor $C_p$ to $-V_s/2$ is dependent upon the current flowing to the inductor $L_1$ during the resonance. Namely, as previously described in regard to the mode 1 M1, the current flowing to the inductor $L_1$ during the resonance is determined by the time period $\Delta t_5$ when current is being injecting to the inductor $L_1$ during mode 5 M5.

Figure 4G:
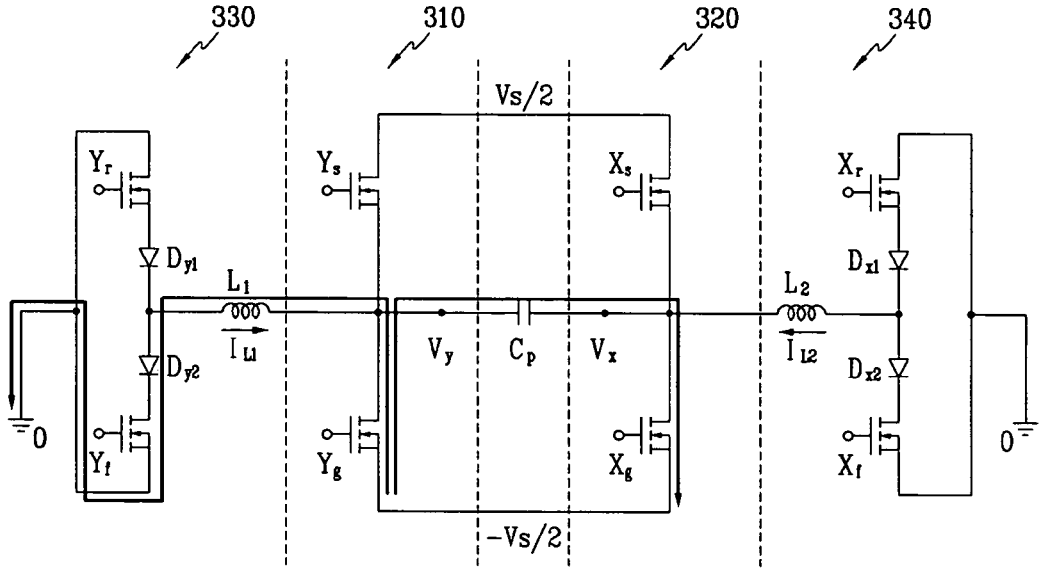

During mode 7 M7, the switch $Y_g$ is turned ON when the Y electrode voltage $V_y$ is decreased to $-V_s/2$, so the Y electrode voltage $V_y$ is sustained at $-V_s/2$. As illustrated in FIG. 4G, the current $I_{L1}$ flowing to the inductor $L_1$ is increased to 0 A with a slope of $V_s/2L_1$ on the current path that includes the body diode of the switch $Y_g$, the inductor $L_1$, and the switch $Y_f$ in sequence.

Figure 4H:
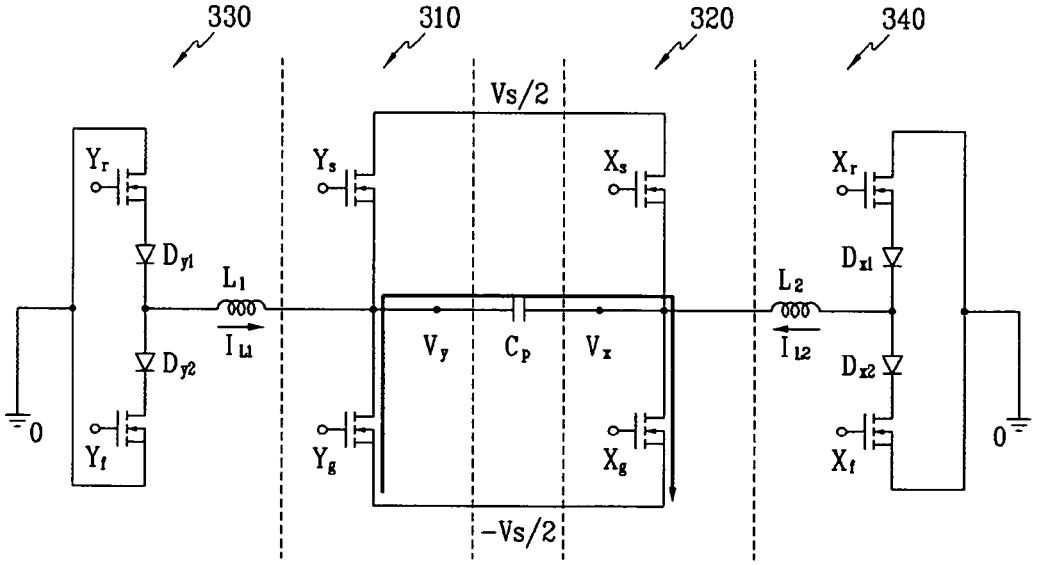

Referring to FIGS. 3 and 4H, during mode 8 M8, the switch $Y_f$ is turned OFF after the current $L_{L1}$ flowing to the inductor $L_1$ becomes 0 A. With the switches $Y_g$ and $X_g$ in the "ON" state, the Y electrode voltage $V_y$ and X electrode voltage $V_x$ of the panel capacitor $C_p$ are both sustained at $-V_s/2$.

During modes 1 to 8 M1 to M8, the voltage $(V_y-V_x)$ (hereinafter referred to as "panel voltage") between the both terminals of the panel capacitor $C_p$ swings between 0V and $V_s$. The operation of switches $X_s$, $X_g$, $X_r$ and $X_f$ and the switches $Y_s$, $Y_g$, $Y_r$ and $Y_f$ during modes 9 to 16 M9 to M16 is the same manner as the operation of switches $Y_s$, $Y_g$, $Y_r$ and $Y_f$ and the switches $X_s$, $X_g$, $X_r$ and $X_f$ during modes 1 to 8 M1 to M8, respectively. The X electrode voltage $V_x$ of the panel capacitor $C_p$ in modes 9 to 16 M9 to M16 has the same waveform as the Y electrode voltage $V_y$ in modes 1 to 8 M1 to M8. Hence, the panel voltage $V_y-V_x$ in modes 9 to 16 M9 to M16 swings between 0V and $-V_s$. The operation of the sustain circuit according to the first embodiment of the present invention in modes 9 to 16 M9 to M16 is known to those skilled in the art and will not be described in detail.

According to the first embodiment of the present invention, the rising time $\Delta T_r$ of the panel voltage can be controlled by regulating the time period $\Delta t_1$ of injecting the current to the inductor $L_1$ in the mode 1 M1. Likewise, the falling time $\Delta T_f$ of the panel voltage can be controlled by regulating the time period $\Delta t_5$ of injecting the current to the inductor $L_1$ during mode 5 M5.

Figure 5:
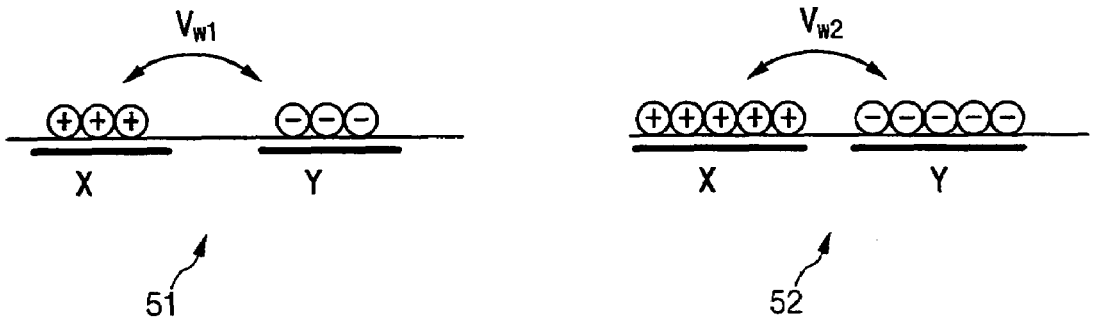
FIG. 5 is a diagram showing the state of wall charges in a discharge cell.

The state of the wall charges in the regions between the X and Y electrodes of the panel capacitor $C_p$, i.e., the discharge cells, is not uniform, so the wall voltage differs for each discharge cell, as illustrated in FIG. 5. With a small accumulation of wall charges, as in discharge cell 51, the wall voltage $V_{w1}$ is low and a discharge firing voltage is high. With a large accumulation of wall charges, as in discharge cell 52, the wall voltage $V_{w2}$ is high and the discharge firing voltage is low. If the wall voltage is high, as in the discharge cell 52, a discharge can occur during the rise of the panel voltage $V_y-V_x$. Namely, the discharge begins during mode 2 M2 during which the switch $Y_s$ is in the "OFF" state, so the power for sustaining the discharge is supplied from the inductor $L_1$ rather than the power source Vs/2. At the beginning of mode 3 M3, the switch $Y_s$ is turned ON to cause a second discharge. As the discharge occurs twice, there is no uniform light emitted on the whole panel. Accordingly, the rising time $\Delta T_r$ of the panel voltage $V_y-V_x$ is preferably short enough to prevent such a non-uniform discharge.

A rapid decrease of the panel voltage $V_y-V_x$ may cause a self-erasing of the wall charges by the movement of resonant charges due to the rapid change of the electric field, resulting in a non-uniform distribution of the wall charges among discharge cells. Contrarily, a slow decrease of the panel voltage $V_y-V_x$ lowers the wall voltage due to recombination of spatial charges, causing no self-erasing. Accordingly, the falling time $\Delta T_f$ of the panel voltage $V_y-V_x$ is preferably longer than the rising time $\Delta T_r$.

Figure 6:
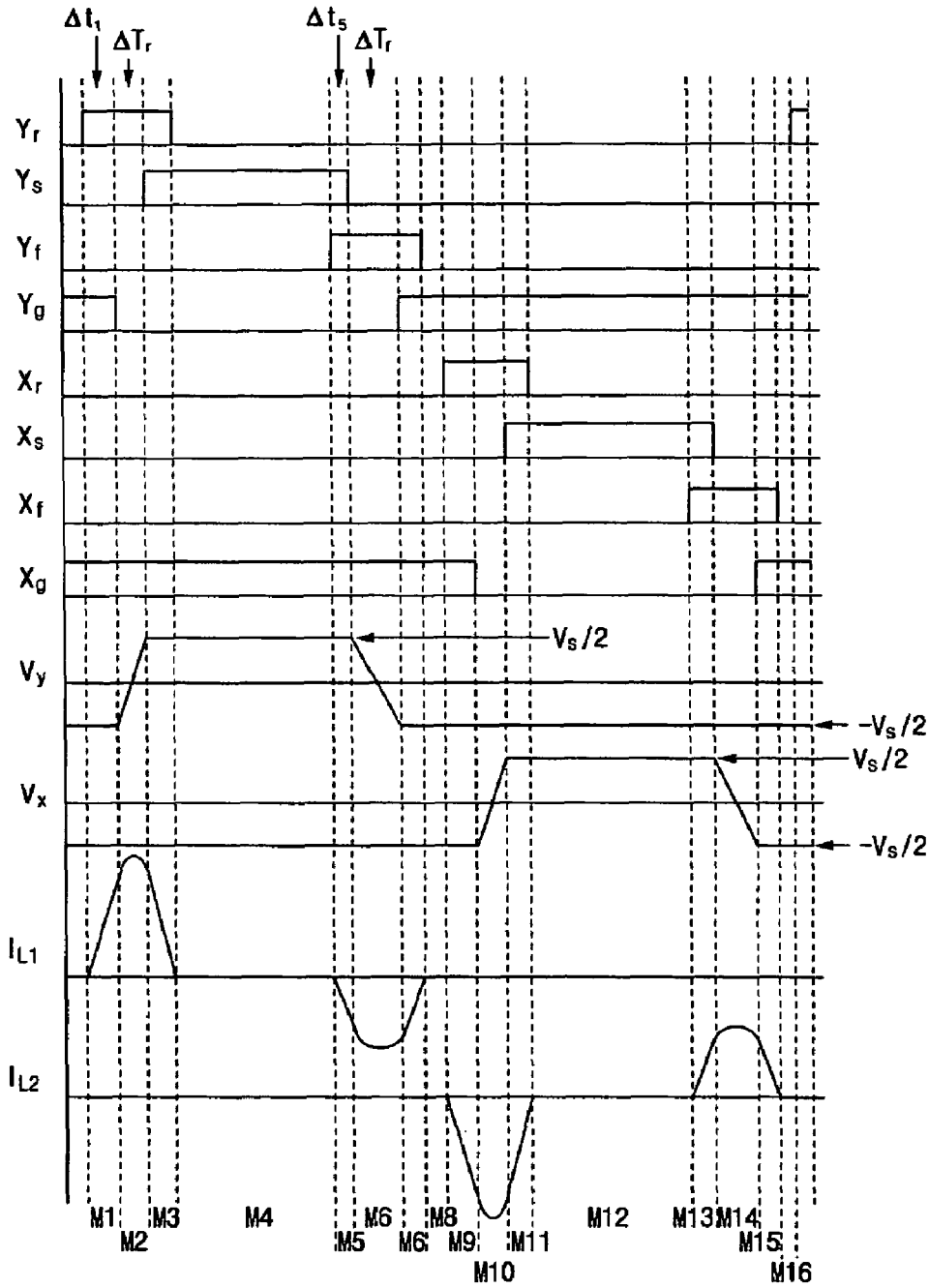
FIG. 6 is a driving timing diagram of the sustain circuit according to the second embodiment of the present invention.

As illustrated in FIG. 6, in a second embodiment of the present invention, the time period $\Delta t_1$ of injecting the current to the inductor $L_1$ during mode 1 M1 is longer than the time period $\Delta t_5$ of injecting the current to the inductor $L_1$ in the mode 5 M5. Accordingly, the rising time $\Delta T_r$ of the panel voltage $V_y-V_x$ is shorter than the falling time $\Delta T_f$.

Referring to FIGS. 3 and 6, a current is injected to the inductor $L_2$ after recovering all the current flowing to the inductor $L_1$ during mode 9 M9 according to the first embodiment. But, the injection of current to the inductor $L_2$ can be performed in either mode 7 M7 or mode 8 M8. Namely, injection of current to the inductor $L_2$, which occurs during mode 9 M9 in the first embodiment, can occur during mode 7 M7 or mode 8 M8. In this manner, the time period of sustaining the panel voltage $V_y-V_x$ at 0V becomes shorter than in the first embodiment.

In the first and second embodiment of the present invention, the voltages supplied from the power sources Vs/2 and −Vs/2 are $V_s/2$ and $-V_s/2$, respectively, so the difference between the Y electrode voltages $V_y$ and the X electrode voltage $V_x$ is the voltage $V_s$ necessary for a sustain-discharge. Differing from this, the sustain-discharge voltage $V_s$ and the ground voltage 0V can be applied to the Y and X electrodes, respectively, which will now be described in detail, referring to FIGS. 7, 8, and 9A to 9H.

Figure 7:
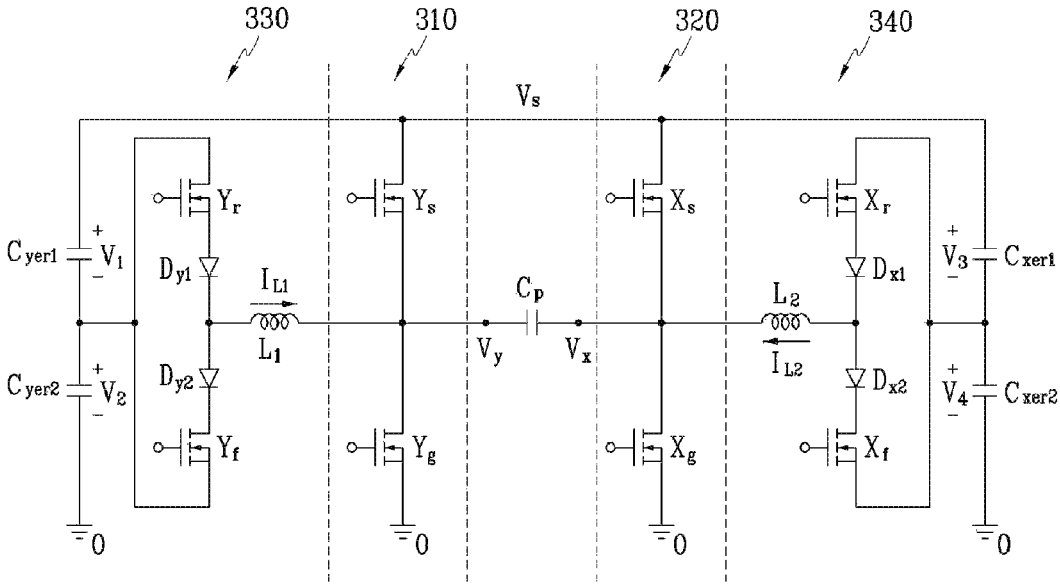
FIG. 7 is a schematic circuit diagram of a sustain circuit according to third embodiment of the present invention.
Figure 8:
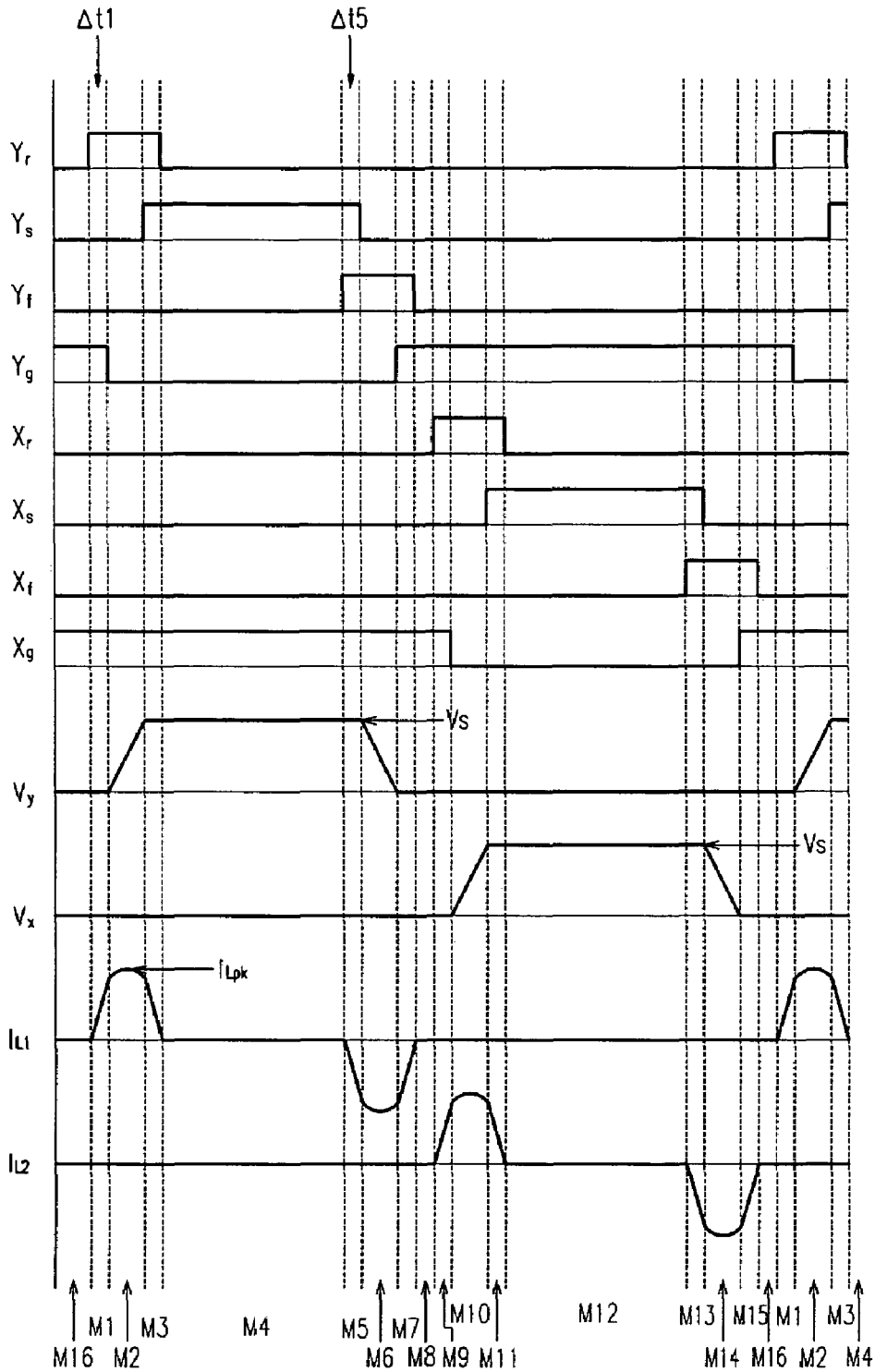
FIG. 8 is a driving timing diagram of the sustain circuit according to the third embodiment of the present invention.

FIG. 7 is a brief sustain circuit according to a third embodiment of the present invention, FIG. 8 is a driving timing diagram of the sustain circuit according to the third embodiment of the present invention, and FIGS. 9A to 9H are current paths of respective modes of the sustain circuit according to the third embodiment of the present invention.

In the sustain circuit as shown in FIG. 7 and differing from the first preferred embodiment, switches $Y_s$ and $X_s$ are coupled to the power source Vs which supplies the sustain-discharge voltage $V_s$, and switches $Y_g$ and Xg are coupled to the ground end 0 for supplying the ground voltage 0V. Also, capacitors $C_{yer1}$ and $C_{yer2}$ are coupled in series between the power source Vs and the ground end 0, and switches $Y_r$ and $Y_f$ are coupled to a node of the capacitors $C_{yer1}$ and $C_{yer2}$. In the like manner, capacitors $C_{xer1}$ and $C_{xer2}$ are coupled in series between the power source Vs and the ground end 0, and switches $X_r$ and $X_f$ are coupled to a node of the capacitors $C_{xer1}$ and $C_{xer2}$. The capacitors $C_{yer1}$, $C_{yer2}$, $C_{xer1}$, and $C_{xer2}$ are respectively charged with voltages $V_1$, $V_2$, $V_3$, and $V_4$.

Figure 9A:
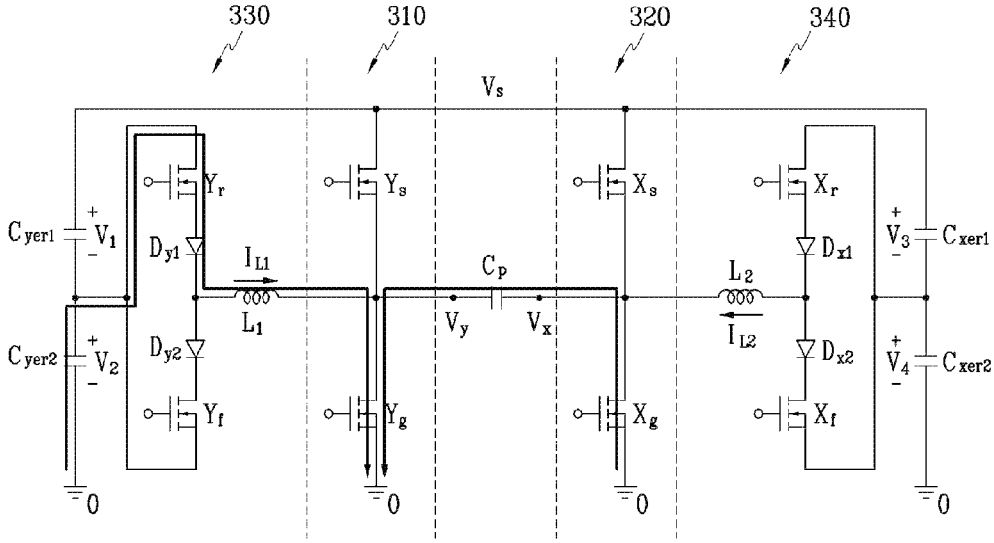
FIGS. 9A to 9H are circuit diagrams showing the current path of each mode in the sustain circuit according to the third embodiment of the present invention.

The operation of the sustain circuit according to the third embodiment of the present invention will now be described by assuming that the voltages $V_2$ and $V_4$ are the voltage $V_s/2$ that is a half of the sustain-discharge voltage $V_s$ with reference to FIGS. 8, and 9A to 9H During mode 1 M1, as illustrated in FIG. 8, the switch $Y_r$ is turned ON, with the switches $Y_g$ and $X_g$ in the "ON" state. Then, a current $I_{L1}$ flowing to the inductor $L_1$ is increased with a slope of $V_s/2L_1$ by a current path as shown in FIG. 9A. That is, during mode 1 M1, the energy is charged in the inductor $L_1$ while the Y and X electrode voltages $V_y$ and $V_x$ of the panel capacitor $C_p$ are both sustained at 0V.

Figure 9B:
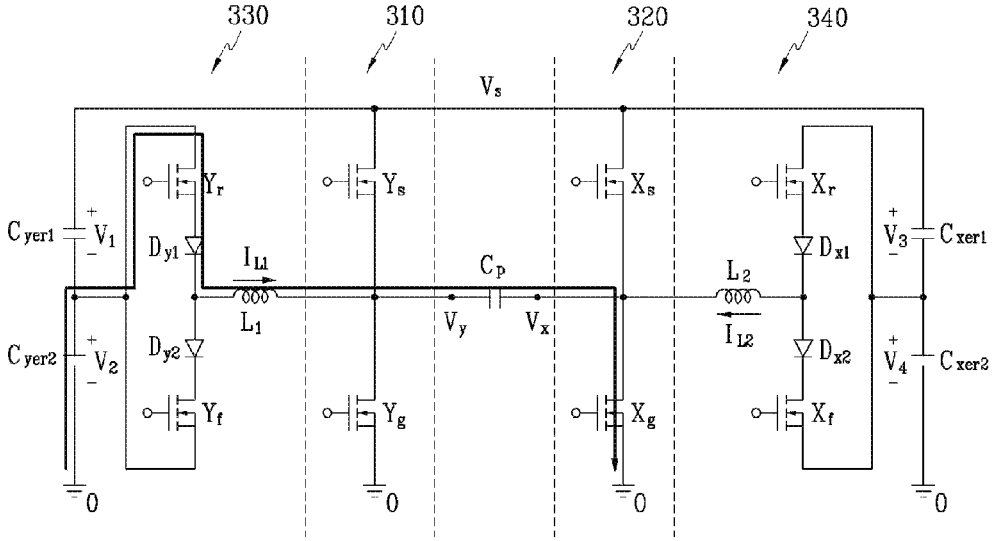

During mode 2 M2, the switch $Y_g$ is turned OFF to form a current path as shown in FIG. 9B, and cause an LC resonance. Due to the LC resonance, the Y electrode voltage $V_y$ of the panel capacitor $C_p$ is increased, particularly to $V_s$ by the body diode of the switch $Y_s$. The LC resonance occurs while a predetermined amount of current flows to the inductor $L_1$ (while the energy is stored in the inductor) in the like manner of the first preferred embodiment of the present invention.

Figure 9C:
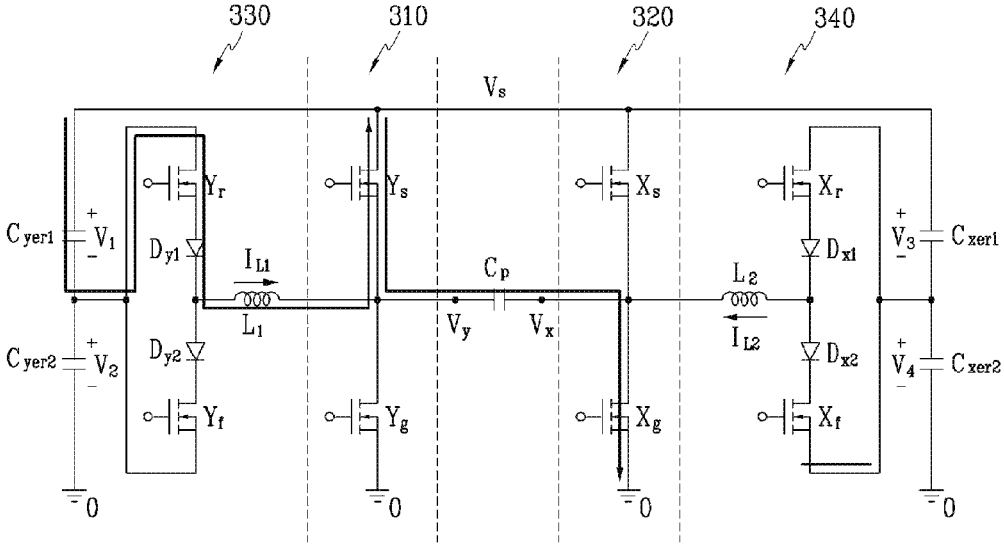

During mode 3 M3, the switch $Y_s$ is turned ON when the Y electrode voltage $V_y$ of the panel capacitor $C_p$ is increased to $V_s$, so the Y electrode voltage $V_y$ is sustained at $V_s$. The current $I_{L1}$ flowing to the inductor $L_1$ according to the path as illustrated in FIG. 9C is recovered to the capacitor $C_{yer1}$.

Figure 9D:
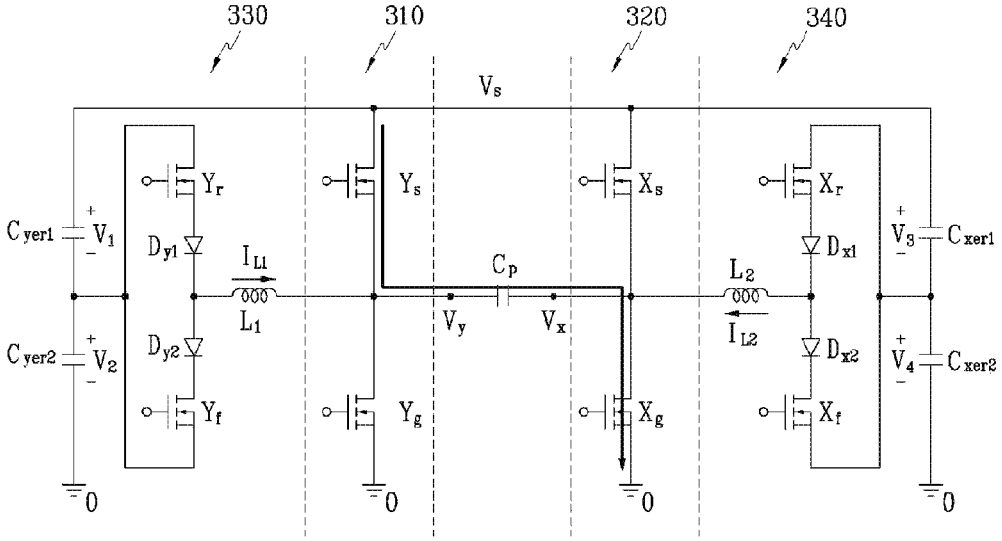

Referring to FIGS. 8 and 9D, during mode 4 M4, the switch $Y_r$ is turned OFF after the current $L_{L1}$ flowing to the inductor $L_1$ becomes 0 A. With the switches $Y_s$ and $X_g$ in the "ON" state, the Y electrode voltages $V_y$ and the X electrode voltage $V_x$ of the panel capacitor $C_p$ are sustained at $V_s$ and 0V, respectively. Since the voltage difference ($V_y$–$V_x$) between the Y and X electrodes becomes a sustain-discharge voltage, a sustain-discharge occurs.

Figure 9E:
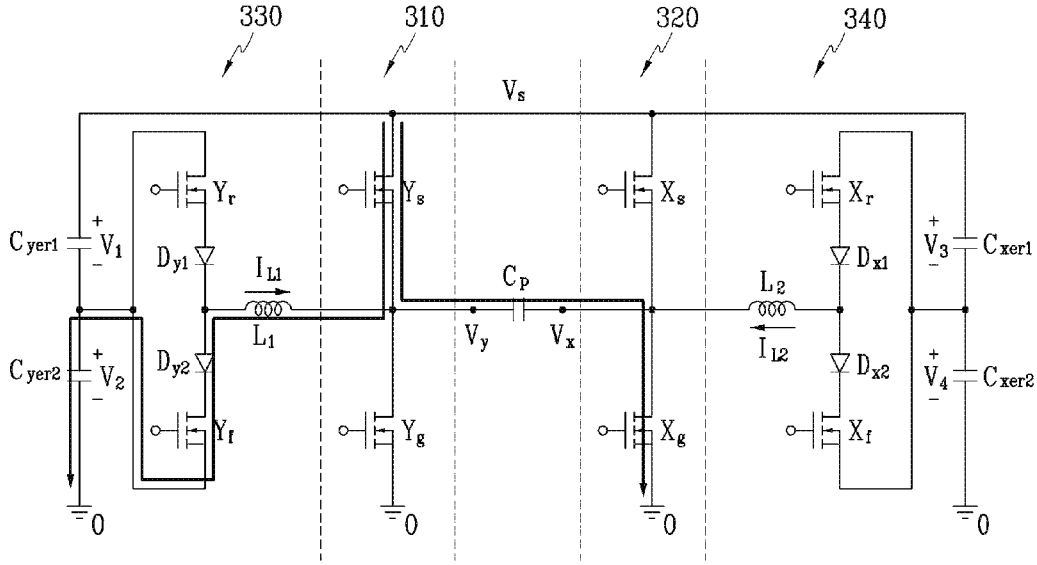

During mode 5 M5, the switch $Y_f$ is turned ON with the switches $Y_s$ and $X_g$ in the "ON" state. Then, as shown in FIG. 9E, a current path is formed, and the current flowing to the inductor $L_1$ is decreased with a slope of $-V_s/2L_1$. During mode 5 M5, a current in the reverse direction of the current of the mode 1 M1 is injected to the inductor $L_1$ while the Y and X electrode voltages $V_y$ and $V_x$ of the panel capacitor $C_p$ are sustained at $V_s$ and 0V, respectively. That is, the energy is charged in the inductor $L_1$.

Figure 9F:
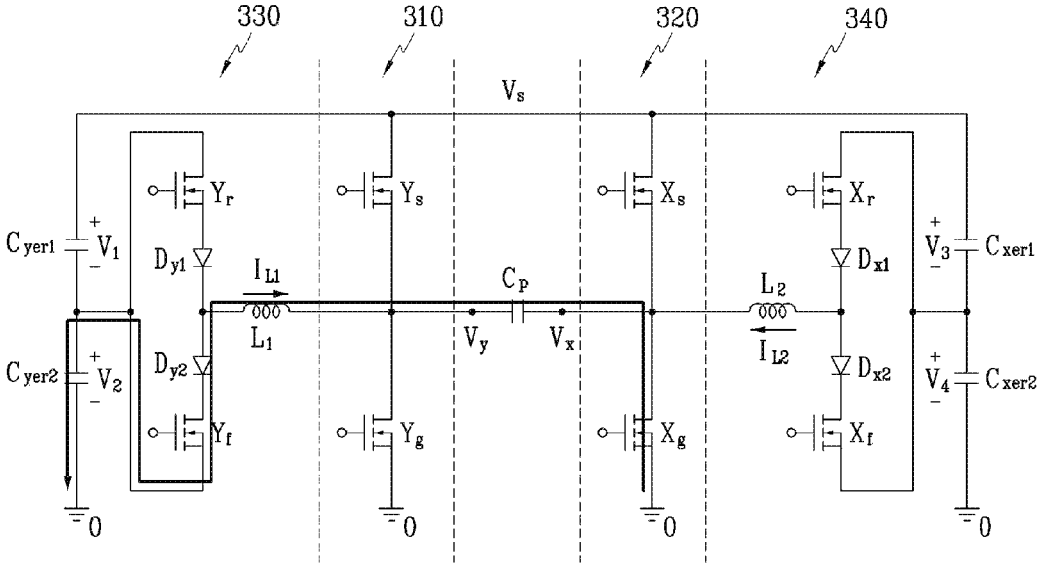

During mode 6 M6, the switch $Y_s$ is turned OFF to form a current path shown in FIG. 9F, thereby causing an LC resonance. Due to the LC resonance, the Y electrode voltage $V_y$ of the panel capacitor $C_p$ is decreased, particularly to 0V by the body diode of the switch $X_g$. The LC resonance occurs while a predetermined amount of current flows to the inductor $L_1$, as in the mode 2 M2 (i.e., while the energy is stored in the inductor).

Figure 9G:
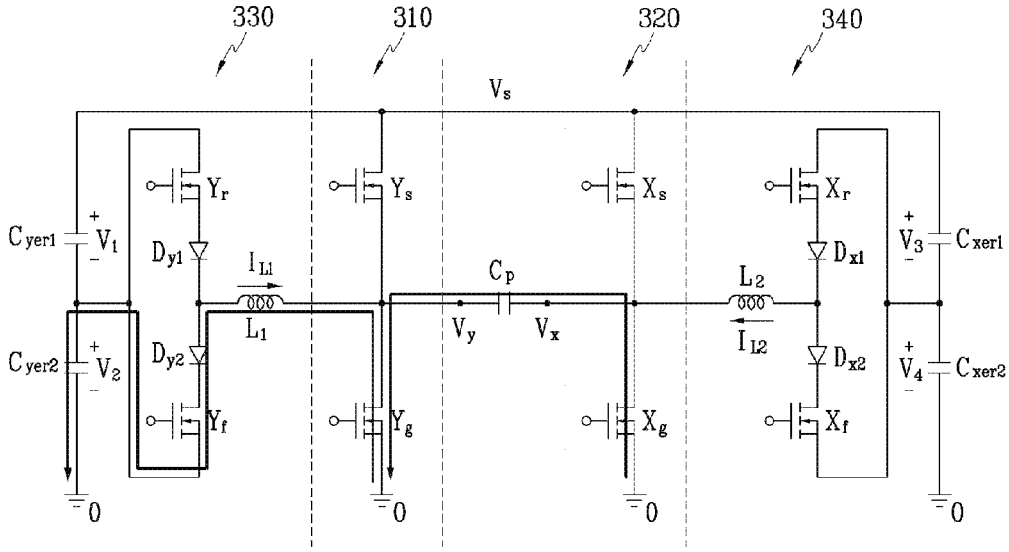

During mode 7 M7, the switch $Y_g$ is turned ON when the Y electrode voltage $V_y$ of the panel capacitor $C_p$ is decreased to 0V, so the Y electrode voltage $V_y$ is sustained at 0V. As illustrated in FIG. 9G, the current $I_{L1}$ flowing to the inductor $L_1$ is restored to the capacitor $C_{yer2}$.

Figure 9H:
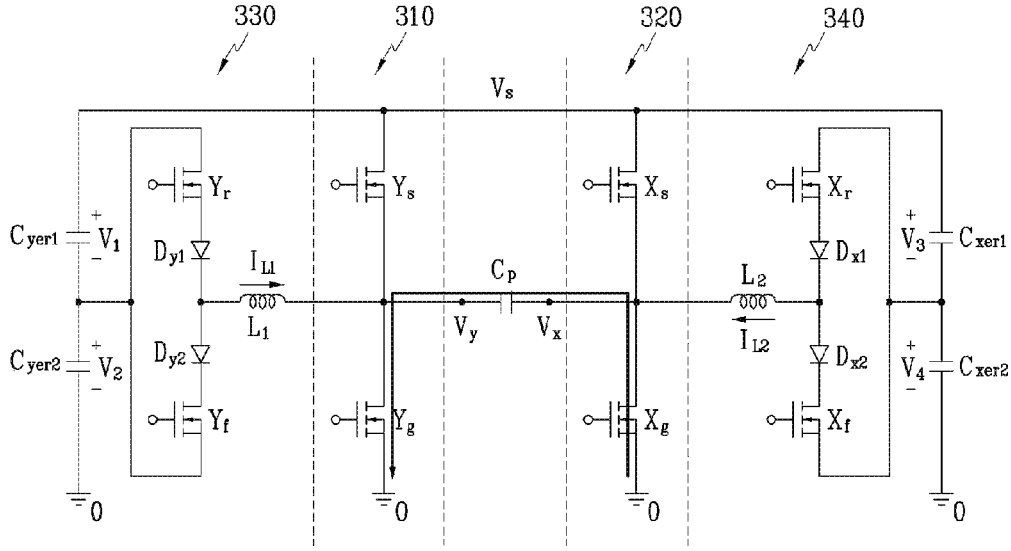

Referring to FIGS. 8 and 9H, during mode 8 M8, the switch $Y_f$ is turned OFF after the current $L_{L1}$ flowing to the inductor $L_1$ becomes 0 A. With the switches $Y_g$ and $X_g$ in the "ON" state, the Y and X electrode voltages $V_y$ and $V_x$ of the panel capacitor $C_p$ are both sustained at 0V.

During modes 1 to 8 M1 to M8 of the third embodiment, similar to the first embodiment, the panel voltage ($V_y$–$V_x$) swings between 0V and $V_s$. As shown in FIG. 8, the operation of switches $X_s$, $X_g$, $X_r$ and $X_f$ and the switches $Y_s$, $Y_g$, $Y_r$ and $Y_f$ during modes 9 to 16 M9 to M16 is the same manner as the operation of switches $Y_s$, $Y_g$, $Y_r$ and $Y_f$ and the switches $X_s$, $X_g$, $X_r$ and $X_f$ during modes 1 to 8 M1 to M8, respectively.

In the third embodiment, the rising time and the falling time of the panel voltage can be controlled by controlling the voltage $V_2$ charged in the capacitor $C_{yer2}$. That is, The voltage level of the capacitor $C_{yer2}$ can be controlled by controlling the period of mode 1 M1 during which the switches $Y_r$ and $Y_g$ are concurrently turned ON, and the period of mode 5 M5 during which the switches $Y_s$ and $Y_f$ are concurrently turned ON.

Figure 10:
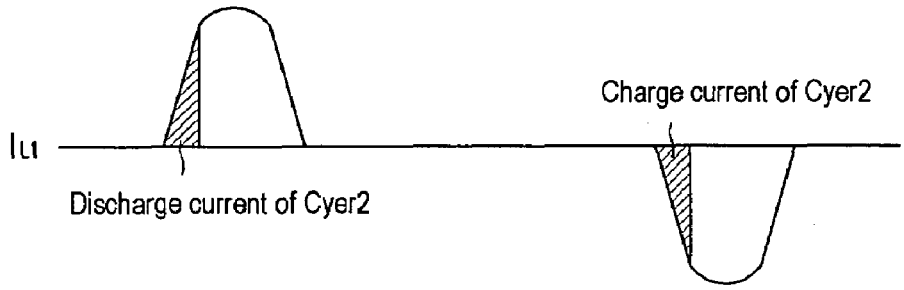
FIGS. 10, 11 and 12 are diagrams of a discharge current and a charge current of the capacitor in the sustain circuit according to the third embodiment of the present invention.
Figure 11:
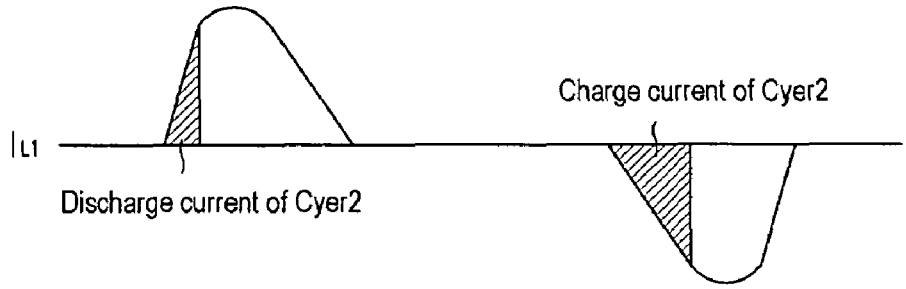
Figure 12:
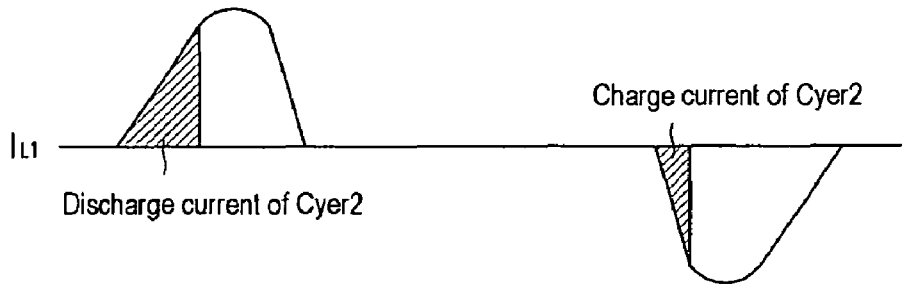

Referring to FIGS. 10 to 12, a method for controlling the voltage level of the capacitor $C_{yer2}$ will now be described.

FIGS. 10 to 12 are diagrams of a discharge current and a charge current of the capacitor $C_{yer2}$ in the sustain circuit according to the third embodiment of the present invention.

As shown in FIG. 10, when the period $\Delta t_1$ of mode 1 and the period $\Delta t_5$ of mode 5 are equal, the amount of current discharged at the capacitor $C_{yer2}$ during mode 1 is substantially equal to the amount of current charging the capacitor $C_{yer2}$ during mode 5. Therefore, both end voltages $V_1$ and $V_2$ of the capacitors $C_{yer1}$ and $C_{yer2}$ are sustained at $V_s/2$.

In this instance, as shown in FIG. 8, when the intensity of the current $I_{L1}$ flowing to the inductor $L_1$ is at a maximum during modes 2 and 6, the Y electrode voltage $V_y$ of the panel capacitor $C_p$ substantially reaches $V_s/2$.

As shown in FIG. 11, when the period $\Delta t_1$ of the mode 1 becomes shorter than the period $\Delta t_5$ of the mode 5, the amount discharge current of the capacitor $C_{yer2}$ becomes less than the amount of charge current of the capacitor $C_{yer2}$ and thus, the both end voltage $V_2$ of the capacitor $C_{yer2}$ becomes greater than the end voltage $V_1$ of the capacitor $C_{yer1}$. That is, the voltage $V_2$ is greater than $V_s/2$.

In this instance, since the voltage $V_2$ applied for resonance of the inductor $L_1$ and the panel capacitor $C_p$ is greater than $V_s/2$ voltage, when the intensity of the current $I_{L1}$ flowing to the inductor $L_1$ becomes the maximum, the Y electrode voltage $V_y$ of the panel capacitor $C_p$ becomes greater than $V_s/2$. Therefore, if a time passes by from the time when the intensity of the current $I_{L1}$ is maximum, the Y electrode voltage $V_y$ becomes $V_s$, and accordingly, the rising time $\Delta T_r$ of the panel voltage shortens.

A shown in FIG. 12, when the period $\Delta t_1$ of the mode 1 is longer than the period $\Delta t_5$ of the mode 5, the amount of discharge current of the capacitor $C_{yer2}$ is greater than the amount of charge current of the capacitor $C_{yer2}$, and the both end voltage $V_2$ of the capacitor $C_{yer2}$ is less than the end voltage $V_1$ of the capacitor $C_{yer1}$. That is, the voltage $V_2$ is less than $V_s/2$.

In this instance, since the voltage $V_2$ applied for the resonance of the inductor $L_1$ and the panel capacitor $C_p$ during mode 2 is less than $V_s/2$, when the intensity of the current $I_{L1}$ flowing to the inductor $L_1$ becomes the maximum, the Y electrode voltage $V_y$ of the panel capacitor $C_p$ becomes less than $V_s/2$. Therefore, since the Y electrode voltage $V_y$ becomes $V_s$ after a long time has passed from the time when the intensity of the current $I_{L1}$ is maximum, the rising time $\Delta T_r$ of the panel voltage becomes longer.

In the third embodiment as described above, the voltage at the capacitor $C_{yer2}$ can be controlled to be at voltages other than $V_s/2$ by controlling the periods of modes 1 and 5 M1 and M5. In this instance, the capacitor $C_{yer1}$ can be removed, and the current can be recovered to the power source Vs in the mode 3.

Also, a power source for supplying the voltage $V_2$ can be used other than the capacitor $C_{yer2}$. In this instance, the rising time and the falling time of the panel voltage can be controlled by setting the voltage $V_2$ as $V_2/2$ and controlling the periods of modes 1 and 5 M1 and M5, as described in the second embodiment.

In the circuit of FIG. 7, the capacitor $C_{yer2}$ can be coupled to the switches $Y_r$ and $Y_f$ other than the ground end 0. Accordingly, the rising time and the falling time of the panel voltage can be controlled by controlling the discharge current (mode 1) and the charge current (mode 5) of the capacitor $C_{yer2}$. Also, a power source can be coupled other than the capacitor $C_{yer2}$.

In the first, second and third embodiments, the voltages $V_s$ and 0V, or the voltages $V_s/2$ and $-V_s/2$ are applied to the Y electrode. Differing from this, two voltages $V_h$ and $V_h-V_s$ having a voltage difference as $V_s$ can be applied to the Y electrode.

Figure 13:
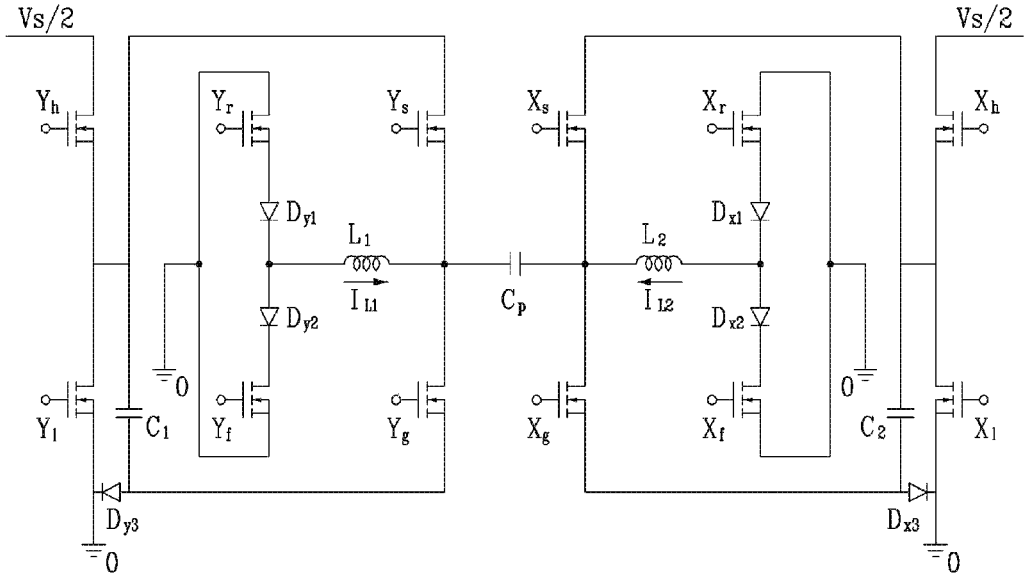
FIG. 13 is a schematic circuit diagram of a sustain circuit according to the fourth embodiment of the present invention.

The driving method according to the first embodiment of the present invention can also be adapted for driving the circuit illustrated in FIG. 13.

Figure 14:
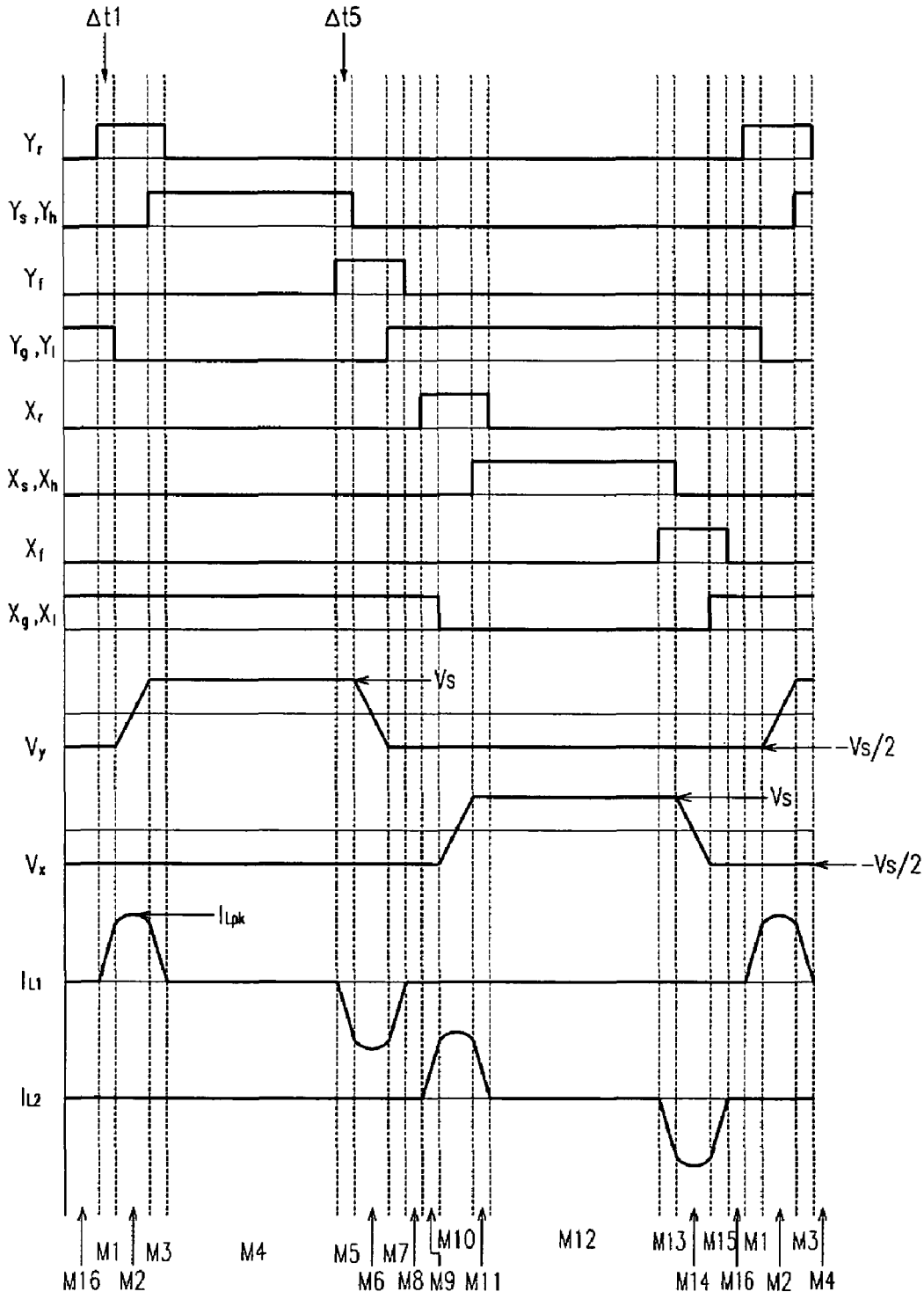
FIG. 14 is a driving timing diagram of the sustain circuit according to the fourth embodiment of the present invention.

FIG. 13 is a schematic circuit diagram of a sustain circuit according to a fourth embodiment of the present invention, and FIG. 14 is a driving timing diagram of the sustain circuit according to the fourth embodiment of the present invention.

As illustrated in FIG. 13, the sustain circuit according to the fourth embodiment of the present invention is the same as described in the first embodiment, excepting that the voltage of $-V_s/2$ is not supplied from the power source −Vs/2 but by using capacitors $C_1$ and $C_2$.

More specifically, the sustain circuit according to the fourth embodiment of the present invention further includes switches $Y_h$, $Y_1$, $X_h$ and $X_1$, capacitors $C_1$ and $C_2$, and diodes $D_{y3}$ and $D_{x3}$. The capacitors $C_1$ and $C_2$ are charged with a voltage of $V_s/2$. The switches $Y_h$ and $Y_1$ are coupled in series between the power source Vs/2 and the ground terminal 0, and the capacitor $C_1$ and the diode $D_{y3}$ are coupled in series between a contact of the switches $Y_h$ and $Y_1$ and the ground terminal 0. The switch $Y_s$ is coupled to a contact of the switches $Y_h$ and $Y_1$, and the switch $Y_g$ is coupled to the contact of the capacitor $C_1$ and the diode $D_{y3}$. Likewise, the switches $X_h$ and $X_1$ are coupled in series between the power source Vs/2 and the ground terminal 0, and the capacitor $C_2$ and the diode $D_{x3}$ are coupled in series between a contact of the switches $X_h$ and $X_1$ and the ground terminal 0. The switch $X_s$ is coupled to the contact of the switches $X_h$ and $X_1$, and the switch $X_g$ is coupled to a contact of the capacitor $C_2$ and the diode $D_{x3}$.

As shown in FIG. 14, the operation of the sustain circuit according to the fourth embodiment of the present invention is the same as the operation described with regard to the first embodiment, except that the switches $Y_h$, $Y_1$, $X_h$ and $X_1$ are operated at the same time as the switches $Y_s$, $Y_g$, $X_s$ and $X_g$, respectively. More specifically, the switches $Y_s$ and $Y_h$ are simultaneously turned ON to supply a voltage of $V_s/2$ from the power source Vs/2 to the panel capacitor $C_p$. Likewise, the switches $X_s$ and $X_h$ are simultaneously turned ON to supply a voltage of $V_s/2$ from the power source Vs/2 to the panel capacitor $C_p$. The switches $Y_g$ and $Y_1$ are simultaneously turned ON to supply a voltage of $-V_s/2$ to the panel capacitor $C_p$ through a path that includes the ground terminal 0, the switch $Y_1$, the capacitor $C_1$, and the switch $Y_g$ in sequence. Likewise, the switches $X_g$ and $X_1$ are simultaneously turned ON to supply a voltage of $-V_s/2$ to the panel capacitor $C_p$ through a path that includes the ground terminal 0, the switch $X_1$, the capacitor $C_2$, and the switch $X_g$ in sequence.

According to the fourth embodiment of the present invention, the power source supplying a voltage of $V_s/2$ is used to supply the voltages of $V_s/2$ and $-V_s/2$ to the panel capacitor $C_p$.

Although the same inductor $L_1$ is used for increasing and decreasing the Y electrode voltage $V_y$ in the first to fourth embodiments of the present invention, independent inductors can also be used for increasing and decreasing the Y electrode voltage $V_y$. When two inductors $L_{11}$ and $L_{12}$ are used, the steps of injecting the current to the inductors (e.g., M1 and M5 in FIG. 3) can be omitted. This embodiment will be described below in detail with reference to FIGS. 15 and 16.

Figure 15:
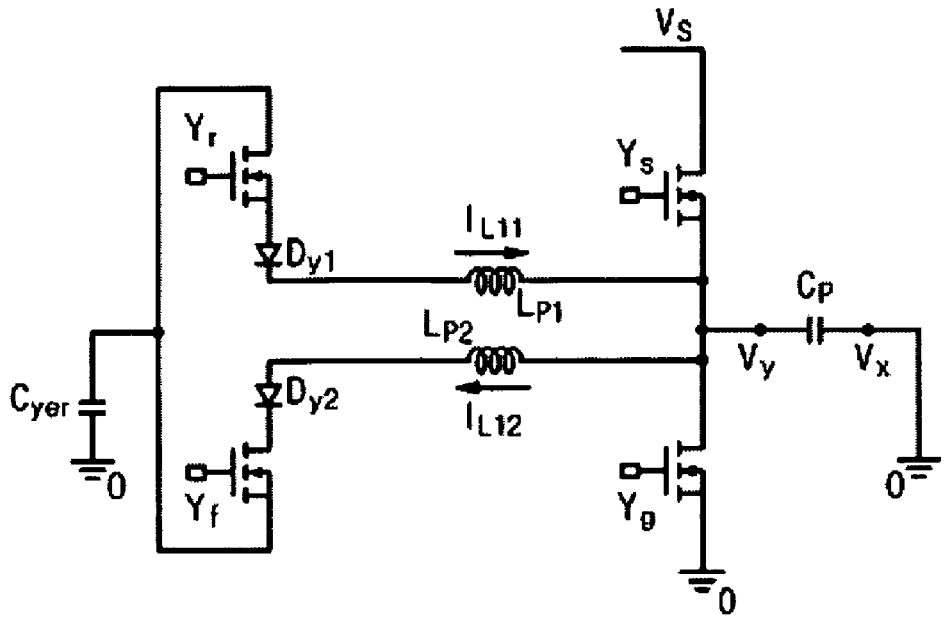
FIG. 15 is a schematic circuit diagram of a sustain circuit according to the fifth embodiment of the present invention.
Figure 16:
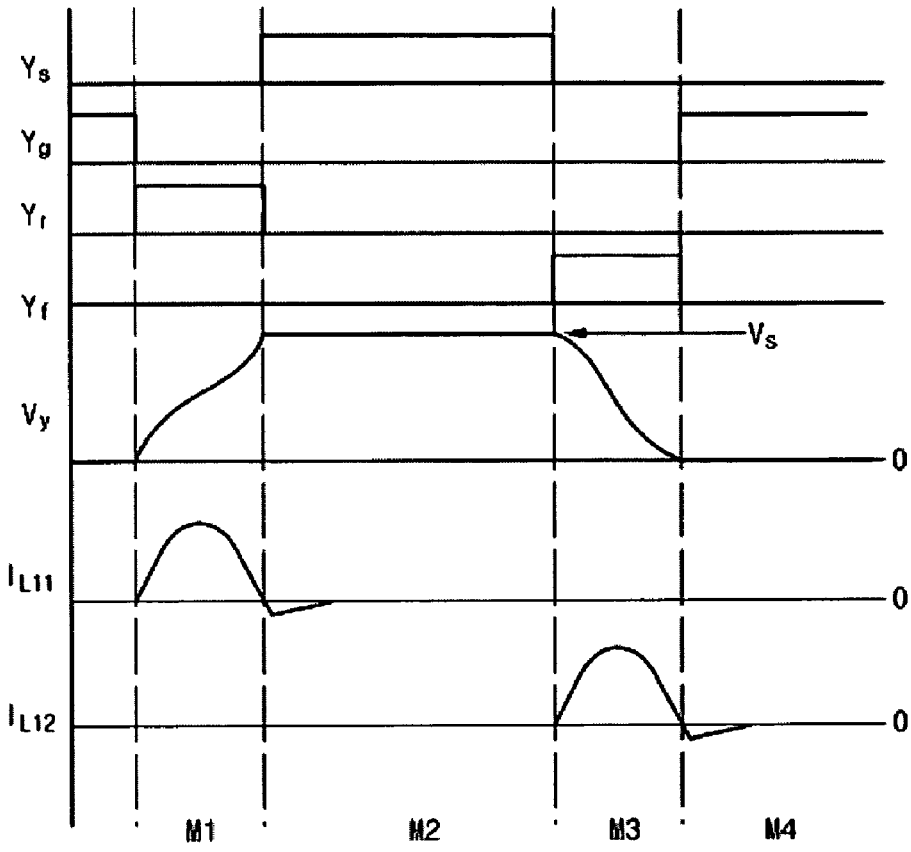
FIG. 16 is a driving timing diagram of the sustain circuit according to the fifth embodiment of the present invention.

FIG. 15 is a schematic circuit diagram of a sustain circuit according to a fifth embodiment of the present invention, and FIG. 16 is a driving timing diagram of the sustain circuit according to the fifth embodiment of the present invention.

In FIG. 15, the X electrode voltage of the panel capacitor is sustained at 0V and only the Y electrode voltage in the sustain circuit is illustrated. The sustain circuit according to the fifth embodiment is the same as described in the first embodiment, excepting inductors $L_{11}$ and $L_{12}$, capacitor $C_{yer}$, power source Vs, and ground terminal 0.

More specifically, switches $Y_s$ and $Y_g$ are coupled in series between the power source Vs and the ground terminal 0. The inductor $L_{11}$ is coupled between a contact of the switches $Y_s$ and $Y_g$ and the switch $Y_r$, and the inductor $L_{12}$ is coupled between the contact of the switches $Y_s$ and $Y_g$ and the switch $Y_f$. The capacitor $C_{yer}$ is coupled between a contact of the switches $Y_r$ and $Y_f$ and the ground terminal 0. The power source Vs supplies a voltage of $V_s$, and the capacitor $C_{yer}$ is charged with a voltage of $V_s/2$. Namely, as different from the first embodiment, the Y electrode voltage $V_y$ swings between 0 and $V_s$ due to the power source Vs and the ground terminal 0.

Referring to FIG. 16, during mode 1 M1, the switch $Y_r$ is turned ON to cause an LC resonance on a current path that includes the capacitor $C_{yer}$, the switch $Y_r$, the inductor $L_{11}$, and the panel capacitor $C_p$ in sequence. Due to the LC resonance, the panel voltage $V_y$ increases and the current $I_{L11}$ of the inductor $L_{11}$ forms a half-period of the sinusoidal wave. During mode 2 M2, when the panel voltage $V_y$ is increased to $V_s$, the switch $Y_r$ is turned OFF and the switch $Y_s$ is turned ON, so the panel voltage $V_y$ is sustained at $V_s$. Namely, a sustain-discharge occurs on the panel during mode 2 M2.

During mode 3 M3, the switch $Y_s$ is turned OFF and the switch $Y_f$ is turned ON to cause an LC resonance on a current path that includes the panel capacitor $C_p$, the inductor $L_{12}$, the switch $Y_f$, and the capacitor $C_{yer}$ in sequence. Due to the LC resonance, the panel voltage $V_y$ decreases and the current $I_{L12}$ of the inductor $L_{12}$ forms a half-period of the sinusoidal wave. During mode 4 M4, when the panel voltage $V_y$ is decreased to 0V, the switch $Y_f$ is turned OFF and the switch $Y_g$ is turned ON, so the panel voltage $V_y$ is sustained at 0V.

The X electrode voltage $V_x$ swings between 0V and $V_s$ while the Y electrode voltage $V_y$ is sustained at 0V, through the procedures during modes 1 to 4 M1 to M4. In this manner, the voltage of $V_s$ necessary for a sustain-discharge can be supplied to the panel.

As expressed by the equations 3 and 4, the rise time $\Delta T_r$ and fall time $\Delta T_f$ of the panel voltage $V_y$ are the functions of the inductances $L_{11}$ and $L_{12}$ of the inductors $L_{11}$ and $L_{12}$ and therefore controllable by regulating the inductances $L_{11}$ and $L_{12}$, respectively. As described previously, it is possible to set the inductance $L_{11}$ less and the inductance $L_{12}$ greater and hence make the rising time $\Delta T_3$ of the panel voltage $V_y$ shorter and the falling time $\Delta T_4$ longer.

$$\Delta T_r=\pi\sqrt{L_{11}C} \quad \text{[Equation 3]}$$

$$\Delta T_f=\pi\sqrt{L_{12}C} \quad \text{[Equation 4]}$$

In the fifth embodiment of the present invention, the power sources Vs/2 and −Vs/2 can be used, similar to the first embodiment. Namely, the switches $Y_s$ and $Y_g$ are coupled to the power sources Vs/2 and −Vs/2, respectively, and the contact of the switches $Y_r$ and $Y_f$ is coupled to the ground terminal 0 rather than the capacitor $C_{yer}$. In this manner, the Y electrode voltage $V_y$ of the panel capacitor $C_p$ swings between $-V_s/2$ and $V_s/2$. The X electrode voltage $V_x$ of the panel capacitor $C_p$ is sustained at $-V_s/2$ when the Y electrode voltage $V_y$ is $V_s/2$, so the voltage of $V_s$ necessary for a sustain-discharge can be supplied to the panel.

According to the present invention, the rising and falling times of the panel voltage can be controlled. Especially, the rising time of the panel voltage is increased to prevent a second discharge during the rising time of the panel voltage, thereby making the discharge uniform. Furthermore, the falling time of the panel voltage is longer than the rising time to prevent a self-erasing of wall charges, thereby acquiring a uniform distribution of the wall charges in discharge cells.

In addition, according to the present invention, the Y electrode voltage is changed while the X electrode voltage is sustained. As a result, the driving pulses applied to the X and Y electrodes can be freely set. The discharge characteristic is improved and the power consumption is reduced since the one electrode voltage is sustained while the other electrode voltage is changed.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A driving method of a plasma display panel including a plurality of first electrodes, the driving method comprising:

increasing a voltage of a first electrode of the plurality of first electrodes through a first inductor coupled with the first electrode;

applying a first voltage to the first electrode;

reducing the voltage of the first electrode through a second inductor coupled with the first electrode; and applying a second voltage, lower than the first voltage, to the first electrode, wherein an inductance of the first inductor differs from an inductance of the second inductor, and wherein a period during which the voltage of the first electrode is increased through the first inductor is different from a period during which the voltage of the first electrode is decreased through the second inductor.

2. The driving method of claim 1, wherein an inductance of the first inductor is less than an inductance of the second inductor.

3. The driving method of claim 1, wherein a peak current flowing to the first inductor, when increasing the voltage of the first electrode, is greater than a peak current flowing to the second inductor when reducing the voltage of the first electrode.

4. The driving method of claim 1, wherein the second voltage comprises a ground voltage.

5. The driving method of claim 1, wherein the first voltage comprises a positive voltage, and the second voltage comprises a negative voltage.

6. The driving method of claim 1, wherein the plasma display panel further comprises a plurality of second electrodes, wherein said applying the first voltage to the first electrode further comprises applying the second voltage to a second electrode of the plurality of second electrodes, and said applying the second voltage to the first electrode further comprises applying the first voltage to the second electrode.

7. A driving method for a plasma display panel including a plurality of first electrodes, the driving method comprising:

increasing a voltage of the first electrode of the plurality of first electrodes during a first period;

applying a first voltage to the first electrode during a second period;

reducing the voltage of the first electrode during a third period, having a length different from the first period; and applying a second voltage, lower than the first voltage, to the first electrode during a fourth period.

8. The driving method of claim 7, wherein the first period is shorter than the third period.

9. The driving method of claim 7, wherein the voltage of the first electrode is increased through a first inductor coupled to the first electrode, the voltage of the first electrode is reduced through a second inductor coupled to the first electrode, and a peak current flowing to the first inductor is greater than a peak current flowing to the second inductor.

10. The driving method of claim 7, wherein the second voltage comprises a ground voltage.

11. The driving method of claim 7, wherein the first voltage comprises a positive voltage, and the second voltage comprises a negative voltage.

12. The driving method of claim 7, wherein the plasma display panel further includes a plurality of second electrodes, wherein said applying the first voltage to the first electrode further comprises applying the second voltage to a second electrode of the plurality of second electrodes, and said applying the second voltage to the first electrode further comprises applying the first voltage to the second electrode.

13. A plasma display panel comprising:

a plurality of first electrodes;

a first transistor coupled between a first power source for supplying a first voltage and a first electrode of the plurality of first electrodes;

a second transistor coupled between a second power source for supplying a second voltage and the first electrode;

a third transistor and a first inductor coupled in serial between the first electrode and a third power source for supplying a third voltage between the first voltage and the second voltage; and a fourth transistor and a second inductor coupled in serial between the first electrode and the third power source, wherein an inductance of the first inductor differs from an inductance of the second inductor, and wherein a period during which the voltage of the first electrode is increased through the first inductor is different from a period during which the voltage of the first electrode is decreased through the second inductor.

14. The plasma display panel of claim 13, further comprising:

a plurality of second electrodes; and a driving circuit for applying the second voltage to a second electrode of the plurality of second electrodes while the first transistor is turned on, and for applying the first voltage to the second electrode while the second transistor is turned on.

15. The plasma display panel of claim 13, wherein the first transistor is actuated after the voltage of the first electrode is changed by actuation of the third transistor, the second transistor is actuated after the voltage of the first electrode is changed by actuation of the fourth transistor, and the first voltage is higher than the second voltage.

16. The plasma display panel of claim 15, wherein an inductance of the first inductor is less than an inductance of the second inductor.

17. The plasma display panel of claim 15, wherein a period during which the voltage of the first electrode is changed by actuation of the third transistor is shorter than a period during which the voltage of the first electrode is changed by actuation of the fourth transistor.

18. The plasma display panel of claim 15, further comprising:

a first diode for forming a current path from the third power source to the first electrode via the first inductor when the third transistor is actuated; and a second diode for forming a current path from the first electrode to the third power source via the first inductor when the fourth transistor is actuated.

19. The plasma display panel of claim 15, wherein the second voltage comprises a ground voltage.

20. The plasma display panel of claim 15, wherein the first voltage comprises a positive voltage, the second voltage comprises a negative voltage, and the third voltage comprises a ground voltage.

* * * * *